US007742364B2

(12) United States Patent
Hiraga et al.

(10) Patent No.: US 7,742,364 B2
(45) Date of Patent: Jun. 22, 2010

(54) TIMEPIECE DISPLAY APPARATUS, MOVEMENT, AND TIMEPIECE

(75) Inventors: Imao Hiraga, Guangdong (CN); Shigeyuki Fujimori, Nagano-ken (JP); Yoichi Hayashi, Nagano-ken (JP); Kenichi Okuhara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 270 days.

(21) Appl. No.: 11/718,086

(22) PCT Filed: Nov. 10, 2005

(86) PCT No.: PCT/JP2005/021168

§ 371 (c)(1),
(2), (4) Date: Apr. 26, 2007

(87) PCT Pub. No.: WO2006/052012

PCT Pub. Date: May 18, 2006

(65) Prior Publication Data

US 2008/0253235 A1 Oct. 16, 2008

(30) Foreign Application Priority Data

| | | |
|---|---|---|
| Nov. 10, 2004 | (JP) | 2004-326032 |
| Jan. 18, 2005 | (JP) | 2005-009969 |
| Feb. 4, 2005 | (JP) | 2005-028971 |
| Oct. 12, 2005 | (JP) | 2005-297246 |

(51) Int. Cl.
*G04B 19/04* (2006.01)
*G04B 19/24* (2006.01)

(52) U.S. Cl. ..... 368/80; 368/28; 368/228

(58) Field of Classification Search ..... 368/28–40, 368/80, 228
See application file for complete search history.

(56) References Cited

U.S. PATENT DOCUMENTS

| | | | | | |
|---|---|---|---|---|---|
| 3,696,609 | A * | 10/1972 | Dubois | 368/220 |
| 4,247,933 | A * | 1/1981 | Nakamura | 368/269 |
| 5,043,955 | A * | 8/1991 | Dubois et al. | 368/228 |
| 5,943,299 | A * | 8/1999 | Genta | 368/28 |
| 6,567,345 | B1 * | 5/2003 | Furukawa et al. | 368/80 |
| 6,826,122 | B2 * | 11/2004 | Zaugg | 368/28 |
| 7,496,003 | B2 * | 2/2009 | Muller | 368/228 |
| 2008/0159082 | A1 * | 7/2008 | Hiraga et al. | 368/228 |

FOREIGN PATENT DOCUMENTS

| | | | |
|---|---|---|---|
| CH | 684455 | A3 * | 2/1993 |
| CH | 690630 | A5 | 11/2000 |
| DE | 19649590 | A1 | 10/1997 |
| EP | 0389739 | A1 | 10/1990 |
| JP | 02281181 | | 11/1990 |
| JP | 2564930 | | 7/1992 |

(Continued)

*Primary Examiner*—Vit W Miska
*Assistant Examiner*—Sean Kayes

(57) ABSTRACT

A timepiece display apparatus causes a day hand to move reciprocally by means of center wheel, driven day wheel, cam, lever, and rack. These wheels, cam, lever, and rack can be easily arranged to fit the available space on the main plate of the movement, and the construction of the display apparatus can thus be simplified. Furthermore, locating the cam between the rotary shaft and rack of the lever portion enables arranging a plurality of parts more compactly than if the cam is disposed to a different location, and affords a simple assembly.

17 Claims, 20 Drawing Sheets

FOREIGN PATENT DOCUMENTS

| | | | |
|---|---|---|---|
| JP | 569695 | | 9/1993 |
| JP | 2600097 | | 4/1994 |
| JP | 10186061 | | 7/1998 |
| JP | 11006880 | | 1/1999 |
| WO | 2004019140 | A2 | 3/2004 |
| WO | WO 2004/019140 | A2 * | 3/2004 |

* cited by examiner

TIMEPIECE DISPLAY APPARATUS, MOVEMENT, AND TIMEPIECE

TECHNICAL FIELD

The present invention relates to a timepiece, a movement, and a display apparatus for a retrograde timepiece that displays the time and calendar information such as the month, date, and weekday in fan-shaped display units.

BACKGROUND ART

Timepieces having a calendar display typically use an annular rotating wheel (such as a date wheel or day wheel) to display calendar information. The numbers 1 to 31 are printed around the outside of this rotating wheel to display the date, and letters such as Sun to Sat are printed to display the day. This rotating wheel is driven to sequentially present the calendar information through a window in the dial.

Display mechanisms for retrograde timepieces that have date, day, or time scales printed in fan-shaped display areas on the face of the dial and use hands to indicate the date and time are also known. To display the weekday, for example, on such a retrograde timepiece, a hand sequentially points to Sun, Mon, Tue, . . . Sat, and then returns to Sun. To achieve this flyback hand action in such a timepiece, Japanese Unexamined Patent Appl. Pub. H11-6880A1 (claim 2, paragraphs [0002] and [0016], and FIG. 3) teaches rendering a spiral thread on the outside circumference of a conventional ring-shaped date wheel (except that the dates are not printed on the wheel) disposed behind the main plate and using this as a cam to display the date. More specifically, Japanese Unexamined Patent Appl. Pub. H11-6880A1 teaches rotatably rendering a pinion to which the hand is attached and a pair of racks that mesh with this pinion from mutually opposite directions on the main plate. Spring pressure exerted through one rack causes the other rack to contact the outside of the rotating cam wheel, thus causing the hand to move reciprocally according to rotation of the date wheel.

The timepiece taught in Japanese Patent 3140700B2 (FIG. 1 and FIG. 6) has a day-turning wheel to which drive force from a spring is transferred, a day wheel that is driven by the day-turning wheel, a cam fixed on this day wheel, a lever that is contacted by this cam and moves circularly, a small day wheel that is driven by a rack formed on this lever, and a small day wheel spring in which power is stored in conjunction with rotation of the small day wheel. Rotation of the lever in contact with the cam thus causes the small day wheel to turn and the hand to move reciprocally.

DISCLOSURE OF THE INVENTION

[Problems the Invention is Intended to Solve]

The date wheel in the arrangement using a conventional date wheel as described in Japanese Unexamined Patent Appl. Pub. H11-6880A1 occupies the space around the outside circumference of the movement, however, and the space limitations of this arrangement are thus great. Furthermore, the plane space occupied by the racks and pinion also cannot be ignored because the pinion and pair of racks are located along the outside circumference of the main plate. As a result, a problem with trying to render the arrangement taught in Japanese Unexamined Patent Appl. Pub. H11-6880 in an existing movement is that significant design changes are required. This makes it difficult to develop a line of products.

In addition to these space-related problems, adding a retrograde display for the weekday and month in addition to the date, or adding in-dial displays for a 24 -hour hand, small second hand, or chronograph, for example, to the arrangement taught in Japanese Unexamined Patent Appl. Pub. H11-6880A1 means that all of the additional parts must also be located inside the inside circumference of the date wheel, and the assembly thus becomes quite complicated.

Moreover, the arrangement taught in Japanese Unexamined Patent Appl. Pub. H11-6880A1 also imposes such design limitations as only being able to render the hand for the date display pointing to the inside from the outside circumference side of the date wheel.

On the other hand, the shape of the cam and lever taught in Japanese Patent 3140700B2 are designed to operate appropriately in conjunction with the layout of the day-turning wheel, day wheel, and small day wheel, and the arrangement related to the day display is limited to the model taught in the patent. More specifically, the arrangement taught in Japanese Patent 3140700 does not anticipate adaptation to other models, can therefore be used to provide only a single model, and any model change requires a significant design change.

Furthermore, in arrangements that use cams and levers to connect the day wheel and small day wheel, for example, disposed to the main plate as taught in Japanese Patent 3140700, the cam and lever tend to be very fine shapes and the structure is thus complex. As a result, design and assembly are difficult.

[Means For Solving the Problems]

To solve the foregoing problems, the present invention relates to a timepiece having a retrograde display apparatus, and relates more particularly to a display apparatus for a timepiece having a simple construction that greatly improves the freedom of design, to a timepiece movement, and to a timepiece incorporating this display apparatus.

A display apparatus for a timepiece according to the present invention has a drive wheel that is rotated by a power source; a driven wheel that is driven by the drive wheel; a cam that is rotated by way of the intervening driven wheel; a lever that can move circularly and is urged in contact with the cam; a rack that moves in according to rotation of the cam by means of the intervening lever; and a pinion that moves in conjunction with the rack and to which an indicating member (hand) can be attached. Given a hypothetical arc centered on the rotary axis of the lever and passing through the rotary axis of the cam, the rack is disposed on the opposite side of the arc as the center of the arc, and the rotary axis of the cam is located between the rack and the rotary axis of the lever.

The present invention thus renders a retrograde display mechanism using a drive wheel, driven wheel, cam, and lever. The hand (indicating member) moves reciprocally as a result of a rack being driven intermittently by rotation of the cam. The arrangement enabling the pinion to move in conjunction with the rack includes arrangements in which the rack and pinion mesh directly and arrangements in which another wheel intervenes between the rack and pinion.

Operation of the display apparatus according to the present invention starts with the driven wheel being turned by the drive power of the drive wheel a distance determined by what the display apparatus is indicating, such as the date, month, or weekday. When the cam is then turned by this intervening driven wheel, the lever contacted by the cam moves circularly. This circular movement of the lever causes the hand attached to the pinion that moves in conjunction with the rack part of the lever to move from the beginning to the end of the range of circular movement of the pinion, and the hand thus sequentially points to the calendar or time information indicated by the display unit. When the hand reaches the end of the range of pinion rotation, the hand is reset to the starting point of the circular movement as a result of the pinion rotating in reverse in conjunction with the movement of the rack on the lever at the end of the cam cycle. The date, month, weekday, or other calendar information, or time is thus repeatedly displayed as a result of this flyback movement of the hand or other indicating member.

The present invention is composed of simple components including wheels such as the drive wheel, driven wheel, and pinion, a cam, a lever, and a rack, these parts can be easily arranged according to the space available on the main plate, and the display apparatus can thus be constructed simply and compactly. Space efficiency is also excellent because the rotary axis of the cam is located between the rack and the rotary axis of the lever. The display apparatus can thus be easily designed and assembled, and consistent quality can be assured.

More specifically, because the rotary axis of the cam is located between the rack and the rotary axis of the lever, and the lever is driven in a circular motion by the cam from inside the range of the lever's circular movement, multiple parts can be arranged more compactly than if the cam is located outside this range of rotation, and the arrangement of the display apparatus is thus simplified.

Furthermore, thus simplifying the structure of the display apparatus makes it possible to render a plurality of retrograde displays, such as a date display and a day display, in the same movement. A chronograph or other type of in-dial display can also be used together with a retrograde display, and the freedom of design can thus be greatly improved.

Yet further, the hands can also be located and oriented as desired by appropriately arranging the drive wheel, driven wheel, cam, lever, and rack.

The location where the rotary axis of the cam is disposed is between the rack and the rotary axis of the lever as described above. For example, if the rack is a substantially linear shape extending from one end to another end, the space between the rack and the rotary axis of the lever in the range between a line connecting the rotary axis of the lever and one end of the rack and a line connecting the rotary axis of the lever and the other end of the rack is where the rotary axis of the cam is located.

Furthermore, it is sufficient if at least the rotary axis of the cam is located between the rack and the rotary axis of the lever, and it is not necessary for all of the cam to be located in this space.

While rendering the rotary axis of the cam between the rack and the rotary axis of the lever affords a space-saving construction, the rack is located on the opposite side as the center of an arc (that is, outside the arc) centered on the rotary axis of the lever and passing through the rotary axis of the cam. As a result, the distance from the rotary axis of the lever to the rack is greater than in an arrangement in which the rack is located inside this arc (that is, on the same side as the center of the arc).

Rotation of the cam can thus cause the lever to move in a large circular path, and a large cam displacement (gap) is not required in order to assure that the lever moves in a sufficiently large circular path. Furthermore, if the cam gap is large, the urging force applied to the lever must be great enough to overcome the friction resistance of the lever and cam in order for the cam to transfer drive power to the lever and reset the lever. The arrangement of the present invention, however, achieves the same circular movement of the lever with the displacement of a smaller cam using less torque, and thus requires less power to drive the display apparatus.

In order to urge and hold the lever in contact with the cam, a spring (urging means) that contacts the lever could be provided so that this spring urges the lever towards the cam. Alternatively, a spring (urging means) could be provided in contact with the pinion, for example, and the urging force of this spring could cause the lever to contact the cam. This urging force working between the lever and cam achieves the fly-back action of the lever resulting from cam rotation, and prevents play in the hand (indicating member) because the rack that is driven circularly by the lever meshes positively with the pinion.

The distance from the rotary axis of the lever to the rotary axis of the pinion is preferably 1.5 to 2.5 times the distance from the rotary axis of the lever to the rotary axis of the cam in a timepiece display apparatus according to the present invention.

Because the distance from the rotary axis of the lever to the rotary axis of the pinion is 1.5 to 2.5 times the distance from the rotary axis of the lever to the rotary axis of the cam, displacement of the lever in the tooth row of the rack is increased to 1.5 to 2.5 times the displacement where the lever contacts the cam. Less cam displacement and less torque are therefore required to make the lever pivot a desired distance.

These distances between the rotary axes of the lever, cam, and pinion also assure sufficient length in the rack portion of the lever. Numerous positions where the pinion can be disposed can thus be rendered along the rack, and numerous timepiece models are thus easily afforded.

The lever in the timepiece display apparatus according to the present invention is preferably positioned surrounding the circumference of the cam and has a detent that contacts the cam.

By rendering the lever so that it surrounds the cam, the lever and cam can be located to move circularly and rotate in substantially the same plane, thus affording a thin display apparatus because the cam and the lever work together without increasing the thickness of the timepiece where the cam contacts the lever.

In another aspect of the invention the rack preferably meshes with the pinion when the pinion is disposed to any of a plurality of different positions.

This aspect of the invention makes manufacturing different models easy by simply changing the location of the pinion because the pinion can be assembled at any of multiple positions and the rack meshes positively with the pinion regardless of which of these pinion positions is used. In other words, the pivot point of the hand (indicating member) changes accordingly when the position of the pinion changes, and the external design of the timepiece can thus be easily varied.

Holes for accepting the rotary shaft of the pinion are also formed in the main plate and pressure plate at each of the positions to which the pinion can be assembled. Furthermore, by using these shaft holes in the main plate and pressure plate to determine the position of the pinion, the structure of the display apparatus does not need to be changed in order to change the model, the same display apparatus and movement can be used in different models of timepieces, and the model can thus be changed quite easily. As a result, model changes can be accommodated at a significantly lower cost.

To enable the rack to mesh with the pinion regardless of the position to which the pinion is assembled, the rack can be formed with sufficient length to rotate the pinion a specific angle of rotation at each pinion position, or a plurality of racks could be provided so that a particular rack meshes with the pinion at a particular position.

Further preferably, the rack has a plurality of partial racks corresponding to the plurality of different pinion positions, and the diameter and/or tooth form is different in each of said partial racks.

When the diameter differs in each of the partial racks, there is a step in the rack between each of the partial rack portions.

When the diameter differs in each of the plural partial racks, the distance that the pinion is advanced by a certain angle of rotation in the lever differs according to which partial rack meshes with the pinion, and the angle of rotation of the hand (indicating member) disposed to the pinion therefore also differs. As a result, different models can be easily manufactured.

Furthermore, when the plural partial racks are thus formed with different diameters, the distance from the rotary axis of the rack to the pinion changes according to which partial rack meshes with the pinion and the position of the pivot point of the hand (indicating member) on the dial changes accordingly. As a result, different designs can be easily manufactured.

When the tooth forms of the plural partial racks differ, a pinion of suitable diameter can be selected according to the tooth form of the partial rack. Because the feed distance of the pinion differs according to the diameter of the pinion, the difference in the angle of rotation of the pinion can be used to render different models.

By thus simply changing the configuration of the rack that is a part of the display apparatus of the present invention, the angle of rotation of the pinion can be changed in addition to changing the position of the pivot point of the hand, thus affording a wide range of design variations.

Yet further preferably, the diameter and/or tooth form of the pinions disposed to the plural pinion positions differ according to the position of the pinion.

Similarly to when the partial racks are formed with a different diameter and/or tooth form, this aspect of the invention also changes the distance that the pinion is advanced by the rack and thus also changes the angle of rotation of the hand. In other words, model changes effected by changing the angle of rotation of the hand can be easily rendered by simply changing the configuration of the pinion that is a part of the display apparatus of the present invention without changing the other components of the display apparatus.

Yet further preferably, the timepiece display apparatus of the present invention also has an urging means causing the lever to contact the cam.

The urging means in this aspect of the invention causes the lever to positively contact the cam without separating from the cam, thus prevents play in the lever and indicating member, and causes the hand (indicating member) to move accurately.

The action of the urging means in a timepiece display apparatus according to this aspect of the invention stores the urging force of the urging means acting on the lever as the lever rotates away from the rotational axis of the cam. When the lever then returns in the reverse direction at the end of the cam cycle, the urging force stored in the urging means is released, and the indicating member is instantaneously reset.

Yet further preferably, the drive wheel is a center wheel to which an hour hand is attached, and an intermediate wheel having a feed pawl for advancing the driven wheel is disposed between the center wheel and the driven wheel.

This aspect of the invention uses the center wheel that is a standard timepiece component as the drive wheel of the display apparatus of the invention. Drive power from the center wheel is thus positively transferred to the intermediate wheel and driven wheel, and design efficiency can be improved.

Furthermore, providing an intermediate wheel in this aspect of the invention results in a ½ speed reduction between the center wheel and intermediate wheel and creates a speed reducing wheel train that reduces the center wheel speed in steps through the intermediate wheel and driven wheel. The overall size of the display apparatus can thus be reduced without increasing the size of the wheels. In addition, the feed pawl of the intermediate wheel can intermittently advance the driven wheel one tooth per day.

Yet further preferably, the rotary axis of the lever is disposed near the center wheel.

This aspect of the invention renders the shaft on which the lever pivots near the center wheel, which is normally located substantially in the center of the main plate, and thus affords a large space for rendering the lever from substantially the center to the edge of the main plate.

A movement according to another aspect of the invention can be assembled with either a display apparatus according to the present invention as described above or a display apparatus other than said timepiece display apparatus comprising the drive wheel in said timepiece display apparatus and a driven wheel driven by said drive wheel.

This aspect of the invention enables rendering in a common movement in which the display apparatus is assembled a retrograde display using the display apparatus according to the present invention as described above, or an in-dial display having a hand that rotates around a round display unit, or a rotating wheel that is disposed behind the dial and is driven circularly to sequentially display letters or other markings on the rotating wheel through a window in the dial. A variety of displays can thus be easily rendered at low cost, and the present invention can thus be advantageously used to develop different timepiece models.

A timepiece according to another aspect of the invention has a display apparatus as described above, and a fan-shaped display unit on which the foregoing indicating member (hand) indicates time or calendar information.

By incorporating the display apparatus of the present invention, this aspect of the invention also affords the same actions and effects of the display apparatus described above.

More specifically, because the shape and position of the fan-shaped display unit, and the orientation of the indicating member (hand), can be freely designed, a retrograde display according to the present invention can be easily rendered based on an existing movement, thus greatly facilitating product development.

BEST MODES FOR CARRYING OUT THE INVENTION

Preferred embodiments of the present invention are described below with reference to the accompanying figures.

Note that in the description of the second and subsequent embodiments elements that are the same as in a previously described embodiment are identified by the same reference numeral and further description thereof is either omitted or simplified.

Embodiment 1

FIG. 1 is an external view of a timepiece 1 according to this embodiment of the invention, and FIG. 2 is an enlarged view of a part of FIG. 1.

A timepiece 1 according to this embodiment of the invention is a wristwatch having a movement 10 and a case member 11 housing the movement 10. The timepiece could be a quartz watch, a mechanical watch, or an electronically controlled mechanical watch. This timepiece 1 is an analog quartz watch. A dial 10A is attached to the movement 10, and a second hand 10B, minute hand 10C, and hour hand 10D that are connected to a wheel train driven by a stepping motor as the power source are rendered at substantially the center of the dial 10A.

The timepiece 1 according to this embodiment of the invention is characterized by having a retrograde display apparatus 100. This display apparatus 100 is incorporated into the movement 10, and displays the date and day by means of the reciprocal action of a day hand 142 and date hand 182 in two fan-shaped display units 141, 181 rendered on the dial 10A. The circular display unit 191 rendered on the dial 10A is a 24-hour dial.

The arrangement of a display apparatus 100 that is typical of the present invention is described next.

FIG. 3 is a plan view showing the arrangement of the display apparatus 100 rendered in the movement 10 from the dial 10A side.

This display apparatus 100 has a day display unit 110 and a date display unit 150 rendered symmetrically to the center of the dial 10A at the 12 o'clock and 6 o'clock positions, and a 24-hour display unit 190 rendered at the 9 o'clock position.

The arrangement of the day display unit 110 is described first below.

FIG. 4 is an enlargement of part of FIG. 3 specifically showing the day display unit 110, and FIG. 5 is a section view of the day display unit 110.

The day display unit 110 is composed of a wheel train 120 for transferring drive power, a control unit 130 which takes drive power from the wheel train 120 and reciprocally drives day hand 142 as an indicating member, and retrograde unit 140 including display unit 141 and day hand 142.

The wheel train 120 includes center wheel 121 as a drive wheel, and intermediate wheel 122, and both wheels 121, 122 are axially supported on the main plate 10X (FIG. 5) of the movement 10.

The center wheel 121 is a sleeved wheel that turns one revolution every 12 hours. The hour hand 10D (FIG. 1) is mounted to the center wheel 121, and drive power from a stepping motor not shown is transferred through a normal drive wheel train. The center wheel 121 has an 8-tooth feed wheel 1211. This feed wheel 1211 engages intermediate wheel 122.

The intermediate wheel 122 reduces the speed of the center wheel 121 by ½ and turns one revolution per day, and transfers drive power from the center wheel 121 to the control unit 130. As shown in FIG. 5, the intermediate wheel 122 has a transfer wheel 1221 (16 teeth) that meshes with the center wheel 121, and an advancing wheel 1222 that advances the driven day wheel 131 and is stacked with the transfer wheel 1221. As shown in FIG. 4, the advancing wheel 1222 has two pawls 1222A for advancing the driven day wheel 131, and these two pawls 1222A cause the driven day wheel 131 to advance two teeth per day.

The control unit 130 is composed of driven day wheel 131, cam 132, and an annular lever 133. When seen in plan view, the driven day wheel 131 and cam 132 are overlapping, and the annular lever 133 moves circularly in the area overlapping the driven day wheel 131.

Drive power transferred from the intermediate wheel 122 causes the driven day wheel 131 to turn. The driven day wheel 131 has 14 teeth and thus turns one revolution every 7 days (one week). A spring 1311 that holds the teeth of the driven day wheel 131 is rendered proximally to the driven day wheel 131. This spring 1311 is a wire spring having the base pivotally supported on the main plate 10X and a triangular tooth-shaped detent 1311A formed at the distal end. The holding force of this spring 1311 allows the driven day wheel 131 to be driven intermittently.

The cam 132 is a flat cam that turns one revolution every 7 days in conjunction with the driven day wheel 131. When seen in plan view, the cam 132 fits within the outside circumference of the driven day wheel 131 and is rendered coaxially to and in unison with the driven day wheel 131 on pressure plate 10Y, which is opposite main plate 10X. This cam 132 has one cam peak 1321 at the end of a spiral profile commencing from starting point 1322. The follower of this cam 132 is annular lever 133.

As shown in FIG. 4, the annular lever 133 is a flat, substantially triangular ring disposed encircling the cam 132, and is pivotally supported on pressure plate 10Y near the center wheel 121 (see FIG. 5) so that the annular lever 133 pivots on rotary shaft 1331. This annular lever 133 is formed in unison with lever portion 134, a rack 135, and a spring 136 as an urging means.

The lever portion 134 opens substantially into a V-shape from the rotary shaft 1331, and a detent 1341 protruding toward the cam 132 is formed on the inside of this V.

The rack 135 connects the otherwise open ends of the V in the lever portion 134. A series of teeth 1351 that mesh with pinion 143 is formed on the outside edge of rack 135.

Assuming an arc R centered on the rotary shaft 1331 of lever portion 134 and passing through the rotary shaft 1325 of the cam 132, this rack 135 is rendered on the opposite side of the arc R as the center (that is, outside of the arc R), and the rotary shaft 1325 of the cam 132 is rendered between the rotary shaft 1331 of the lever portion 134 and the rack 135.

The spring 136 bends in a U-shape from the end portion at the side where the detent 1341 of the lever portion 134 is formed around to the rotary shaft 1331 side, and the distal end 1361 of the spring 136 contacts a raised inclined portion of the pressure plate 10Y. The urging force of the spring 136 thus causes the detent 1341 of the lever portion 134 to contact the cam 132.

The retrograde unit 140 is composed of pinion 143, day hand 142 attached to the pinion 143, and a fan-shaped display unit 141 on the dial 10A.

As shown in FIG. 1, display unit 141 is the fan-shaped arc on the 12 o'clock side of the dial 10A with the fan shape bulging towards a line joining the 3 o'clock and 9 o'clock positions on the dial 10A. The abbreviations SUN to SAT are printed at a specific interval along the fan-shaped arc of the display unit 141, thus forming a scale 1411 denoting the weekdays.

The pinion 143 is advanced by the teeth 1351 of the rack 135 and causes the day hand 142 attached to the rotary shaft thereof to move, and is rendered at the center of the arc of the fan-shaped display unit 141. The range of the angle of rotation of this pinion 143 corresponds to the angle of the fan shape of the display unit 141, and the number of teeth on the pinion 143 is determined by the number of teeth 1351 in the rack 135.

The arrangement of the date display unit 150 is described next with reference to FIG. 3.

The date display unit 150 is composed of a wheel train 160 that transfers drive power, a control unit 170 that receives drive power from the wheel train 160 and causes the date hand 182 to move reciprocally as an indicating member, and a retrograde unit 180 including display unit 181 and date hand 182. The arrangement of this date display unit 150 and the above-described day display unit 110 are basically the same, and differ primarily in the number of teeth on the wheels and rack due to the differences in indicating the date and day.

The wheel train 160 includes center wheel 121 and date-turning wheel 162 as an intermediate wheel. These wheels 121 and 162 are rotationally supported on the main plate 10X of the movement 10.

The center wheel 121 is the same drive wheel that is used to drive the day display unit 110, and the feed wheel 1211 (eight teeth) of the center wheel 121 meshes with the intermediate wheel 122 of the day display unit 110 and the date-turning wheel 162.

The date-tuning wheel 162 reduces the speed of the center wheel 121 by ½ and turns one revolution per day (24 hours), and transfers drive power from the center wheel 121 to the control unit 170. The date-turning wheel 162 includes a 16-tooth date-tuning transfer wheel 1621 (shown in the background in FIG. 3) that meshes with the center wheel 121, and a 24-tooth date-turning advancing wheel 1622 (shown in the foreground in FIG. 3) in a stacked arrangement. A feed pawl 1621A is formed on the date-tuning transfer wheel 1621. The feed pawl 1621A of the date-turning wheel 162 causes the date follower 171 to instantaneously advance one tooth per day, and the date-turning advancing wheel 1622 causes the small star wheel 193 of the 24-hour display unit 190 described below to advance.

The control unit 170 is composed of date follower 171, cam 172, and annular lever 173. When seen in plan view, the cam 172 and annular lever 173 are on top of the date follower 171.

The date follower 171 is turned by drive power transferred from the date-turning wheel 162, has 31 teeth and turns one revolution every 31 days. A spring 1711 that is identical to the spring 1311 of the driven day wheel 131 is similarly rendered near the date follower 171, and the force of this spring 1711 causes the date follower 171 to be driven intermittently.

The cam 172 is a flat cam that turns one revolution every 31 days in conjunction with date follower 171. The cam 172 is disposed inside the outside circumference of the date follower 171 when seen in plan view, and is rendered coaxially to and in unison with the date follower 171. The follower of cam 172 is annular lever 173.

Similarly to annular lever 133, annular lever 173 is a substantially triangular annular frame having a lever portion 174, rack 175, and spring 176 formed in unison, and is disposed to pivot around the cam 172 on rotary shaft 1731 near the center wheel 121. A detent 1741 projecting toward the cam 172 is formed inside the annular lever 173, and this detent 1741 is held in contact with the cam 172 by the urging force of the spring 176. Wheel teeth not shown that mesh with the pinion 183 are formed on the outside of the rack 175.

Retrograde unit 180 is composed of pinion 183, date hand 182 attached to the pinion 183, and display unit 181 on the dial 10A.

As shown in FIG. 1, the display unit 181 is the fan-shaped arc portion at the 6 o'clock side of the dial 10A facing display unit 141 curving convexly towards an imaginary line between the 9 o'clock and 3 o'clock positions. The numbers 1 to 31 are printed at a specific interval along the fan-shaped arc of the display unit 181, thus forming scale 1811 indicating the date.

The pinion 183 is located at the center of the circle of the fan-shaped display unit 181, is advanced by a series of teeth not shown on the rack 175, and thus causes the date hand 182 attached to the wheel shaft to move. The range of the angle of rotation of this pinion 183 corresponds to the angle of the fan shape of the display unit 181, and the number of teeth on the pinion 183 is determined by the number of teeth in the rack 175.

The 24-hour display unit 190 is composed of a small star wheel 193 (24 teeth) that meshes with the above-described date-turning advancing wheel 1622, a 24-hour hand 192 attached to the small star wheel 193, and a display unit 191 rendered at the 9 o'clock. Rotational movement of the 24-hour hand 192 indicates the hour on a 24-hour dial in the display unit 191.

Calendar information is displayed by the foregoing timepiece 1 as described below.

Operation of the day display is described first. Drive power from a stepping motor is transferred through a wheel train not shown to the center wheel 121 of the wheel train 120, and the center wheel 121 turns one revolution every 12 hours, that is, two revolutions per day. The speed of center wheel 121 rotation is reduced ½ when the rotation is transferred from the center wheel 121 to intermediate wheel 122, and intermediate wheel 122 thus turns one revolution per day. The two pawls 1222A on the intermediate wheel 122 advance the driven day wheel 131 two teeth per day. The drive force transferred to this driven day wheel 131 is transferred speed reduced to 1/7 referenced to the rotational speed of the intermediate wheel 122.

Rotation of the driven day wheel 131 is also transferred through driven day wheel 131 to cam 132, and the cam 132 and driven day wheel 131 together turn one revolution every 7 days (one week).

The cam 132 and annular lever 133 constitute the control unit 130 of the day display unit 110. Rotation of the cam 132 causes annular lever 133 to move circularly, and pinion 143 meshing with rack 135 causes day hand 142 to move through the display unit 141. More specifically, rotation of the cam 132 causes the detent 1341 contacting cam 132 to move away from the cam 132 center, and the overall annular lever 133 thus moves circularly to the left as seen in FIG. 4. This circular movement of the annular lever 133 causes the pinion 143 engaging the teeth 1351 to rotate in the forward direction (to the right as seen in FIG. 4), elastically deforming the U-shaped portion of the spring 136 and storing this deflection (spring force). The day hand 142 moves according to rotation of the pinion 143, and the day hand 142 thus sequentially points to positions along the scale 1411 of the display unit 141.

When the day hand 142 is thus advanced to the end 1411B (see FIG. 2) of the scale 1411 on the display unit 141, the annular lever 133 contacts the cam 132 near the cam peak 1321. When the driven day wheel 131 is next advanced by the pawls 1222A, cam 132 turns in conjunction with rotation of the driven day wheel 131, and the cam 132 cycle ends. When the cam 132 cycle thus ends, the point of contact between the detent 1341 and cam 132 moves instantaneously from the cam peak 1321 to the starting point 1322 of the cam profile, the annular lever 133 moves circularly to the right as seen in FIG. 4, and spring 136 is reset. Movement of the rack 135 at this time causes the pinion 143 to turn in reverse and the day hand 142 thus flies back (zeroes) to the starting point 1411A of the scale 1411 on the display unit 141. The next cam 132 cycle then starts, thus causing the pinion 143 to rotate forward and back according to rotation of the annular lever 133 following rotation of the cam 132 as described above, and the retrograde movement of the day hand 142 thus repeats over a period of 7 days.

For the date display, rotation of the center wheel 121 is transferred to the date-turning wheel 162, and the date-turning wheel 162 rotates once a day. The feed pawl 1621A of the date-turning wheel 162 also causes the date follower 171 to advance one tooth per day. The drive force conveyed to the date follower 171 is transferred speed reduced to 1/31 of the rotation velocity of the date-turning wheel 162.

A rotation of the date follower 171 is also transferred to the cam 172, and the cam 172 and date follower 171 turn one revolution every 31 days.

The cam 172 and annular lever 173 constitute the control unit 170 of the date display unit 150. Rotation of the cam 172 causes the annular lever 173 to rotate, thus causing the pinion 183 to rotate, and thus causing the date hand 182 attached to the pinion 183 to move reciprocally in the display unit 181, over a 31 day period between the start 1811A and end 1811B positions of the scale 1811.

The drive force transferred from the center wheel 121 to the date-tuning wheel 162 is also transferred to the small star wheel 193 of the 24-hour display unit 190, and the 24-hour hand 192 thus rotates around the display unit 191 in conjunction with rotation of the small star wheel 193.

The day display unit 110 and date display unit 150 thus display plural types of calendar information while the 24-hour display unit 190 displays the time on a 24-hour dial.

The embodiment of the invention thus described affords the following benefits.

(1-1) The center wheel 121, driven day wheel 131, date follower 171, cams 132 and 172, and annular levers 133 and 173 are arranged to render a retrograde display causing the date hand 182 and day hand 142 to move in a reciprocating motion, and these wheels 121, 131, 171, cams 132, 172 and annular levers 133, 173 can be combined appropriately as desired.

Furthermore, because the cam 132 is rendered on driven day wheel 131, the range of annular lever 133 rotation overlaps the driven day wheel 131, and cam 172 and annular lever 173 overlap the date follower 171 when seen in plan view, the footprint of the display apparatus 100 on the main plate 10X is very small. More specifically, the annular levers 133 and 173 are rendered without protruding greatly from the driven day wheel 131 and date follower 171.

This greatly increases the freedom of design and layout. The center wheel 121, driven day wheel 131, date follower 171, cams 132 and 172, and annular levers 133, 173 can thus be easily arranged in the movement, and construction is thus simplified.

(1-2) By forming the lever portion 134 and rack 135 in unison as annular lever 133, and locating the cam 132 inside the annular lever 133, the location where the lever portion 134 and rack 135 rotate can be rendered in substantially the same plane as the location where the cam 132 rotates. This also applies to the annular lever 173 and cam 172.

This enables more efficient use of space through the thickness of the timepiece.

Space efficiency is also improved in the plane direction by forming detent 1341 on the annular lever 133 so that the detent 1341 contacts the cam 132 from the inside of the annular lever 133.

(1-3) A retrograde display that is extremely compact in both the plane and thickness directions is afforded as a result of (1-1) and (1-2) above, and this arrangement can be rendered in substantially the same space required for an in-dial display in which the hands rotate in a circle. A movement driving the hands in a circle can thus be replaced with a retrograde display causing the day hand 142 and date hand 182 to move reciprocally, thus facilitating product development.

(1-4) Because plural retrograde displays such as the day display unit 110 and date display unit 150 are compactly rendered at the 12 o'clock and 6 o'clock positions, a 24-hour display unit 190 can be rendered at the 9 o'clock position.

The direction indicated by the day hand 142 and date hand 182 and the location, shape, and orientation of the display units 141 and 181 can also be easily changed by appropriately combining the center wheel 121, driven day wheel 131, date follower 171, cams 132 and 172, and annular levers 133 and 173.

Timepieces with a variety of designs can thus be provided.

(1-5) Space is used efficiently and design efficiency is good because the center wheel 121 used as the drive wheel is normally present in an analog timepiece. Space efficiency is further improved in this embodiment of the invention because the center wheel 121 is also used as the drive wheel of the day display unit 110 and date display unit 150.

(1-6) Furthermore, locating intermediate wheel 122 between center wheel 121 and driven day wheel 131, and locating date-tuning wheel 162 between center wheel 121 and date follower 171, renders a speed-reducing wheel train that sequentially reduces the wheel speed from the center wheel 121 to the intermediate wheel 122 and then driven day wheel 131, and from the center wheel 121 to date-turning wheel 162 and then date follower 171. Large wheels and a complicated structure are thus not needed.

(1-7) Referring to the day display unit 110, the rotary shaft 1325 of the cam 132 is rendered space-efficiently between the rotary shaft 1331 of the annular lever 133 and the rack 135, and the rack 135 is located opposite (that is, outside of arc R) the center of circular arc R centered on the rotary shaft 1331 of the annular lever 133 and passing through the rotary shaft 1325 of the cam 132. Compared with an arrangement having the rack 135 inside this arc R, the distance from the rotary shaft 1331 of the annular lever 133 to the rack 135 is thus great. As a result, the circular movement of the annular lever 133 driven by rotation of the cam 132 can be increased without increasing the displacement (gap) of the cam 132 needed to assure large circular movement of the annular lever 133. Furthermore, if the cam 132 gap is large, the urging force applied to the annular lever 133 must be great enough to overcome the friction resistance of the annular lever 133 and cam 132 in order for the cam 132 to transfer drive power to the annular lever 133 and reset the annular lever 133. The arrangement of the present invention, however, achieves the same circular movement of the annular lever 133 with the displacement of a smaller cam 132 using less torque, and thus requires less power to drive the display apparatus.

It should be noted that the rack 175 of the date display unit 150 is similarly located outside the circular arc R centered on the rotary shaft 1731 of the annular lever 173 and passing through the rotary shaft 1725 of the cam 172, and the rotary shaft 1725 of the cam 172 is located between rotary shaft 1731 of the annular lever 173 and rack 175, thus affording the same effect as in the day display unit 110 described above.

Furthermore, the urging force working between the annular lever 133 and cam 132 causes the annular lever 133 to reset as a result of cam 132 rotation, and causes the rack 135 which moves circularly by way of intervening annular lever 133 to mesh positively with pinion 143, thus preventing play in the movement of day hand 142.

Embodiment 2

A second embodiment of the present invention is described next with reference to the accompanying figures.

In a timepiece display apparatus according to this embodiment of the invention the length of the rack that meshes with the pinion is greater than the length of the rack 135 on annular lever 133 in the previous embodiment.

The face of a timepiece 2A according to this embodiment of the invention is shown in FIG. 6.

This timepiece 2A is a wristwatch (watch) having a movement 20 as the drive apparatus and a case member 11 housing this movement 20. The timepiece could be a quartz watch, a mechanical watch, or an electronically controlled mechanical watch. The timepiece 2A according to this embodiment of the invention is an analog quartz watch. A dial 20A is attached to the movement 20, and the time (hour, minute, second), day, date, and hour (24-hour dial) are displayed on the dial 20A. More specifically, a second hand 10B, minute hand 10C, and hour hand 10D are rendered at substantially the center of the dial 20A to show the time. A fan-shaped retrograde display unit 241 having a day hand 242 that moves reciprocally to indicate the weekday is rendered at the 10:30 position between the 10 o'clock and 11 o'clock markings on the dial 20A. Fan-shaped display units 295 and 191 rendered at the 3 o'clock and 6 o'clock positions indicate the date and hour (24-hour dial), respectively, by means of date hand 294 and 24-hour hand 192.

FIG. 7 is a plan view of the movement 20 from the dial 20A side, and FIG. 8 is a section view showing the major components of the movement 20.

The movement for driving the second hand 10B, minute hand 10C, and hour hand 10D is the same as a conventional analog quartz watch, and is composed of a circuit board with a quartz oscillator, a stepping motor having a coil, stator, and rotor, a drive wheel train including fourth wheel 20S, second wheel 20M, and center wheel 121 shown in FIG. 8 (as well as day wheel third wheel, and fifth wheel not shown), and a battery 20B as the drive power source. The stepping motor is driven by a pulse signal that is generated by the quartz oscillator and frequency divided by a circuit block. The drive force of the stepping motor is then transferred through the rotor to the drive wheel train, thereby driving the second hand 10B disposed to the fourth wheel 20S, the minute hand 10C disposed to the second wheel 20M, and the hour hand 10D disposed to the center wheel 121. The number of stepping motors is not specifically limited, and two stepping motors could be used, one for the driving the second hand 10B and one for driving the minute hand 10C and hour hand 10D.

The construction of the date display apparatus 290 and the construction of the 24-hour display unit 190 are described next.

As shown in FIG. 7 a date display apparatus 290 for displaying the date, a 24-hour display unit 190 for displaying the hour in a 24-hour dial, and a day display apparatus 200 for displaying the weekday in a retrograde display as described below are assembled in this movement 20.

The date display apparatus 290 is composed of center wheel 121 disposed in the center of a main plate 20X that is substantially round when seen in plan view, a date-turning wheel 292, date star wheel 293, date hand 294, and display unit 295 (shown in FIG. 6).

The feed wheel 1211 of the center wheel 121 engages date-turning wheel 292.

The date-turning wheel 292 speed reduces the rotation of center wheel 121 to ½ and turns one revolution per day (24 hours). This date-turning wheel 292 has a 16-tooth date-turning transfer wheel 2921 (shown in the background in FIG. 7) that engages the center wheel 121, and coaxial date-turning feed wheel 2922 (shown in the foreground in FIG. 7) with 24 teeth. A feed pawl 2921A is formed on the date-turning transfer wheel 2921, and this feed pawl 2921A advances the date star wheel 293 one tooth per day.

The date star wheel 293 has 31 teeth and advances one revolution every 31 days. The date hand 294 is attached to this date star wheel 293, and the date is indicated by rotation of the date hand 294 around the display unit 295 (FIG. 6).

The teeth of the date star wheel 293 are urged by the distal end of a jumper (not shown) of which the base end is attached to the main plate 20X. The urging force of this jumper intermittently drives the date hand 294.

The 24-hour display unit 190 includes display unit 191, date-turning wheel 292, small star wheel 193, 24-hour hand 192, and display unit 191 (FIG. 6).

The center wheel 121 and date-turning wheel 292 are used by both the 24-hour display unit 190 and date display apparatus 290.

The small star wheel 193 has 24 teeth, meshes with the date-turning feed wheel 2922, and thus rotates once per day. The 24-hour hand 192 is attached to the small star wheel 193, and the 24-hour hand 192 rotates around the display unit 191 (FIG. 6) to display the hour in a 24-hour dial.

The arrangement of the day display apparatus 200, which is the characteristic feature of this embodiment of the invention, is described in detail below.

FIG. 9 is an enlarged view of a portion of FIG. 7.

The day display apparatus 200 includes wheel train 210 for transferring drive power, a control unit 230 for reciprocally driving day hand 242 (FIG. 6) as the indicating member by means of drive power transferred from the wheel train 210, and retrograde unit 240 including display unit 241 and day hand 242 (FIG. 6).

The wheel train 210 includes center wheel 121 as the drive wheel, and day-turning wheel 212 as an intermediate wheel that meshes with center wheel 121.

The center wheel 121 is common to display unit 191, date display apparatus 290, and day display apparatus 200, and further detailed description thereof is omitted here. The feed wheel 1211 (8 teeth) of the center wheel 121 engages day-turning wheel 212.

The day-tuning wheel 212 speed reduces rotation of the center wheel 121 by ½ and transfers drive power from the center wheel 121 to control unit 230. This day-turning wheel 212 has 16 teeth, a feed pawl 2121 for advancing the intermediate day wheel 231 as shown in FIG. 9, and the intermediate day wheel 231 is thus advanced one tooth per day by feed pawl 2121.

The control unit 230 is composed of intermediate day wheel 231 as a follower, cam 232, and annular lever 233. The intermediate day wheel 231 and cam 232 overlap when seen in plan view, and annular lever 233 moves circularly through the area where the cam 232 overlaps the intermediate day wheel 231.

The cam 232 and annular lever 233 overlap through the thickness D (FIG. 8) of the timepiece 2A, and the cam 232 is located between the rack 235 and rotary axis 20Z1 of the annular lever 233 in the plane direction intersecting the thickness direction D (FIG. 8).

The distance from the rotary axis 20Z1 of the annular lever 233 to the rotary axis 2325 of the cam 232 is distance T1, the distance from the rotary axis 20Z1 of the annular lever 233 to the rotary axis 2431 of the small day wheel 243 is distance T2, and T2 is approximately twice T1.

The intermediate day wheel 231 is driven rotationally by drive power received from the day-turning wheel 212, has seven teeth, and turns one revolution every 7 days (one week). A jumper 2311 for urging the teeth of the intermediate day wheel 231 is disposed near intermediate day wheel 231. The urging force of this jumper 2311 intermittently drives the intermediate day wheel 231.

The cam 232 is a flat cam that turns one revolution every seven days in conjunction with intermediate day wheel 231, is rendered within the outside circumference of the intermediate day wheel 231 when seen in plan view, and as shown in FIG. 8 is rendered coaxially to and in unison with the intermediate day wheel 231 between the main plate 20X and opposing pressure plate 20Y. Because the cam 232 and intermediate day wheel 231 are coaxially disposed, rotation of the intermediate day wheel 231 can be dependably transferred to the cam 232. As shown in FIG. 9, the cam 232 has one cam peak 2321 with an Archimedean spiral formed from the start 2322 of the cam profile to the cam peak 2321. The follower of this cam 232 is the annular lever 233.

The annular lever 233 is a thin, flat annular member rendered surrounding the cam 232, is pivotally supported at rotary axis 20Z1 disposed to bearing 20Z (FIG. 8) near center wheel 121, and thus moves circularly around rotary axis 20Z1. The annular lever 233 is composed of a lever part 234, rack 235, and spring 236 formed in unison.

The lever part 234 has an opening 2342 in which the cam 232 is contained, and a detent 2341 formed projecting toward the cam 232 on the inside of this opening 2342.

The rack 235 is formed in an arc on the opposite end of the annular lever 233 as the rotary axis 20Z1. The form and number of teeth on the rack 235 are determined according to the form and number of the teeth on the small day wheel 243, and the length of the rack 235 is determined in relation to the angle of rotation of the small day wheel 243. Whether the small day wheel 243 is located at position A denoted by the solid line in FIG. 9 (the 10:30 position, that is, halfway between the 10 o'clock and 11 o'clock positions) or position B denoted by the double-dot dash line (the 9:30 position, that is, halfway between the 9 o'clock and 10 o'clock positions), the length of the rack 235 is only long enough to turn the small day wheel 243 a specific angle.

Assuming an arc R passing through the rotary axis 2325 of the cam 232 and centered on the rotary axis 20Z1 of the lever part 234, the rack 235 is located on the side away from the center of arc R, and the rotary axis 2325 of the cam 232 is located between rotary axis 20Z1 of lever part 234 and the rack 235.

The spring 236 is formed in a U-shape extending from the end on the side where the detent 2341 of lever part 234 is formed to the rotary axis 20Z1 side with the distal end 2361 engaged by a protrusion 20Z2 formed at bearing 20Z (FIG. 8). The urging force of this spring 236 causes the detent 2341 of lever part 234 to contact cam 232.

The retrograde unit 240 is composed of small day wheel 243 as the pinion, day hand 242 (FIG. 6) attached to the small day wheel 243, and fan-shaped display unit 241 on the dial 20A.

As shown in FIG. 6, the display unit 241 is rendered with the circular center of the fan shape on the outside edge side of the dial 20A and the circular arc portion of the fan shape facing the center of dial 20A. The weekdays are printed with the letters SUN to SAT printed at a specific interval along the fan-shaped arc of the display unit 241, thus forming scale 2411 denoting the days of the week.

The small day wheel 243 is advanced by rack 235 and moves the day hand 242 attached to the rotary shaft of the small day wheel 243. The angle of rotation of the small day wheel 243 corresponds to the angle of the fan shape of the display unit 241, and is 108° in this embodiment of the invention.

The small day wheel 243 can be rendered at position A denoted by the solid line in FIG. 9 (that is, the 10:30 position), or at position B (the 9:30 position), and either position A or position B is selected as the position for incorporating the small day wheel 243. This relates to model changes of timepiece 2A (FIG. 6) described below.

The small day wheel 243 is pivotally supported between the main plate 20X and pressure plate 20Y as shown in FIG. 8 at a position equivalent to the circular center O (FIG. 6) of the fan shape of the display unit 241. A hole 20Y1, 20Y2 accepting the rotary axis 2431 of the small day wheel 243 is formed in main plate 20X and pressure plate 20Y, respectively, and these holes 20Y1, 20Y2 are thus formed at the position corresponding to position A or B.

FIG. 10 shows timepiece 2B, which is a different model of timepiece 2A. This timepiece 2B changes the position of the display unit 241 on the dial 20A of timepiece 2A. More specifically, while the center of the fan shape of display unit 241 is rendered at the 10:30 position between the 10 o'clock and 11 o'clock positions in timepiece 2A, the center of the fan shape of display unit 241 is rendered at the 9:30 position between the 9 o'clock and 10 o'clock positions in timepiece 2B.

While the location of the display unit 241 thus differs, the movement 20 including day display apparatus 200 is the same in timepieces 2A and 2B except that the small day wheel 243 is assembled to a different location corresponding to the different location of the display unit 241. More specifically, while the small day wheel 243 is assembled in timepiece 2A at position A denoted by the solid line in FIG. 9, the small day wheel 243 is assembled in timepiece 2B at position B as denoted by the double-dot dash line in FIG. 9.

Because the rack 235 has sufficient length as described above, the small day wheel 243 can mesh with the rack 235 of the annular lever 233 whether the small day wheel 243 is located at position A or position B.

The arrangement of timepieces 2A and 2B is described above. Operation of the day display apparatus 200 is described next. Note that the operation of the day display apparatus 200 is the same whether the small day wheel 243 is assembled to position A or position B as shown in FIG. 9.

The drive force of the stepping motor is transferred through a wheel train not shown to the center wheel 121, and the center wheel 121 turns one revolution every 12 hours, or two revolution per day. The speed of center wheel 121 rotation is reduced ½ when the rotation is transferred from the center wheel 121 to day-turning wheel 212, and day-turning wheel 212 thus turns one revolution per day. The feed pawl 2121 on the day-turning wheel 212 advances the intermediate day wheel 231 one tooth per day. The drive force transferred to this intermediate day wheel 231 is transferred speed reduced to 1/7 referenced to the rotational speed of the day-turning wheel 212.

Rotation of the intermediate day wheel 231 is also transferred through intermediate day wheel 231 to cam 232, and the cam 232 and intermediate day wheel 231 turn one revolution in seven days (one week).

The cam 232 and annular lever 233 constitute the control unit 230. Rotation of the cam 232 causes annular lever 233 to move circularly, and small day wheel 243 meshing with rack 235 causes day hand 242 to move through the display unit 241. More specifically, rotation of the cam 232 causes the detent 2341 contacting cam 232 to move away from the center of cam 232 rotation, and the overall annular lever 233 thus moves circularly to the left as seen in FIG. 9. This circular movement of the annular lever 233 causes the small day wheel 243 engaging the rack 235 to rotate in the forward direction (to the right as seen in FIG. 9), elastically deforming the U-shaped portion of the spring 236 and storing this deflection (spring force). The day hand 242 moves according to rotation of the small day wheel 243, and the day hand 242 thus sequentially points to positions along the scale 2411 of the display unit 241.

Because the distance T2 between the rotary axis 20Z1 of the annular lever 233 and the rotary axis 2431 of the small day wheel 243 is twice the distance T1 between the rotary axis 20Z1 of the annular lever 233 and the rotary axis 2325 of cam 232, rotation of the cam 232 in the range of circular movement of the annular lever 233 reliably causes the annular lever 233 to move circularly. Furthermore, because the displacement of the annular lever 233 in the teeth of the rack 235 is amplified to nearly twice the displacement of the detent 2341 that contacts the cam 232, the small day wheel 243 can be easily and positively advanced a specific angle of rotation (108° in this embodiment).

When the day hand 242 thus advances to the end 2411B (FIG. 6) of the display unit 241 scale 2411, the annular lever 233 contacts the cam 232 near the cam peak 2321. When the intermediate day wheel 231 is then next advanced by the feed pawl 2121, cam 232 turns in conjunction with rotation of the intermediate day wheel 231, and the cam 232 period ends. When the cam 232 period ends, the spring force stored in spring 236 causes the point of contact between detent 2341 and cam 232 to move instantaneously from cam peak 2321 to starting end 2322, and the annular lever 233 moves circularly to the right as seen in FIG. 9 and resets. As a result, the circular movement of rack 235 causes small day wheel 243 to rotate in reverse, and the day hand 242 thus flies back (zeroes) to the beginning 2411A of the scale 2411 of the display unit 241. The next cam 232 period thus starts, the small day wheel 243 thus repeatedly rotates forward and reverse according to the circular movement of annular lever 233 driven by rotation of cam 232 as described above, and the day hand 242 moves reciprocally in a seven day cycle.

In addition to the effects of the first embodiment described above, this second embodiment also has the following effects.

(2-1) The length of the rack 235 is determined so that the small day wheel 243 of the day display apparatus 200 in timepiece 2A or 2B can be assembled to either position A or position B. As a result, different models of timepieces 2A, 2B can be manufactured quite easily by simply changing the location where the small day wheel 243 is assembled. The appearance can thus be easily varied because the center of day hand 242 rotation and the location of the display unit 241 on the dial 20A are different in timepiece 2A and timepiece 2B.

Because the movement 20 containing this day display apparatus 200 is the same in both timepiece 2A and timepiece 2B, model changes do not require changing the arrangement of the day display apparatus 200. The cost can thus be greatly reduced.

(2-2) The day display apparatus 200 is composed of simple parts including such wheels as center wheel 121, intermediate day wheel 231, and small day wheel 243, cam 232, and annular lever 233, and these parts can be easily disposed within the space of the main plate 20X, thus preventing the structure of the retrograde day display apparatus 200 from becoming complicated. The day display apparatus 200 can thus be easily designed and assembled, and consistent quality can be assured. Furthermore, because construction is simple, models small enough for ladies' watches can also be easily rendered.

Because the construction of the day display apparatus 200 is thus simple, the overall structure of the movement 20 also comprising date display apparatus 290 and 24-hour display unit 190 is not complicated, and multifunctional timepieces 2A, 2B having functions for displaying the day, month, 24-hour time, and current time (hour, minute, and second) can be provided at low cost.

(2-3) By disposing the cam 232 and intermediate day wheel 231 overlapping coaxially, and disposing the annular lever 233 to move circularly in an area overlapping the intermediate day wheel 231, the plane size of the day display apparatus 200 can be reduced because cam 232, intermediate day wheel 231, and annular lever 233 overlap. The layout of the day display apparatus 200 can thus be easily arranged to desirably locate the day display apparatus 200.

(2-4) The position where the annular lever 233 moves circularly and the position where the cam 232 moves circularly can be located in substantially the same plane as a result of rendering the lever part 234 and rack 235 in unison in the annular lever 233 and locating the cam 232 inside an opening 2342 rendered in the annular lever 233. The day display apparatus 200 thus does not inflate the thickness of the timepiece 2A, 2B and affords a thin timepiece 2A, 2B.

In addition, detent 2341 formed on annular lever 233 contacts the cam 232 on the inside of the annular lever 233, thus using space in the plane direction more efficiently.

(2-5) A center wheel 121 normally used in an analog timepiece is used as part of the day display apparatus 200, date display apparatus 290, and 24-hour display unit 190, thus eliminating design waste and saving space.

(2-6) Rendering the day-turning wheel 212 between the center wheel 121 and intermediate day wheel 231 affords a speed-reducing wheel train that sequentially reduces wheel speed from the center wheel 121 to the day-turning wheel 212 and then to the intermediate day wheel 231, thus avoiding the need for larger wheels and a more complex structure.

(2-7) In the day display apparatus 200 of timepieces 2A and 2B, the cam 232 is located between the rotary axis 20Z1 of the annular lever 233 and the rack 235, and rotation of the cam 232 on the inside of the range in which the annular lever 233 moves circularly causes the annular lever 233 to move circularly. Compared with an arrangement in which the cam 232 is located outside the range of circular movement of the annular lever 233, the parts can thus be arranged more compactly and an extremely simple construction can be achieved.

The strength of the annular lever 233 can also be increased because the annular lever 233 is rendered surrounding the cam 232, and the annular lever 233 can thus be rendered with a large space around the cam 232. Design and assembly are thus simple, and the annular lever 233 can be driven to move stably in a circular path.

Furthermore, rendering the cam 232 coaxially to the intermediate day wheel 231 affords a simpler construction, positively transfers rotation of the intermediate day wheel 231 to the cam 232, and can reliably control circular movement of the annular lever 233 by means of rotation of the intermediate day wheel 231 and cam 232.

(2-8) Furthermore, because the distance T2 from the rotary axis 20Z1 of the annular lever 233 to the rotary axis 2431 of the small day wheel 243 is approximately twice the distance T1 from the rotary axis 20Z1 of annular lever 233 to the rotary axis 2325 of the cam 232, rotation of the cam 232 inside the range of circular movement of the annular lever 233 can reliably cause the annular lever 233 to move circularly and reliably and easily advance the small day wheel 243 a specific angle of rotation.

Note that the ratio between distance T2 and distance T1 is approximately 2:1 to facilitate rendering this day display apparatus in the movement 20 of a timepiece of a typical size and improve the manufacturability of the parts, but this ratio can be desirably set in the range of 1.5 times to 2.5 times. If the ratio between T1 and T2 is less than 1.5 times, sufficiently advancing the small day wheel 243 may not be possible, and it becomes difficult to assemble the day display apparatus 200 in the movement 20 if the ratio exceeds 2.5 times.

(2-9) Furthermore, because the cam 232 is located inside the range of circular movement of the annular lever 233 and distance T2 is approximately twice distance T1 (desirably set in the range 1.5 times to 2.5 times), sufficient length can be assured for the rack 235, and the small day wheel 243 can be assembled to a plurality of positions, specifically at position A or position B, along the rack 235. Different timepiece models 2A and 2B can thus be easily manufactured by simply changing the location to which the small day wheel 243 is assembled. Because the center of day hand 242 rotation and the position of the display unit 241 on the dial 20A are different in timepieces 2A and 2B, the appearance of the timepiece can be easily varied. The cost per model can thus be reduced while expanding the line of products.

Furthermore, the position to which the small day wheel 243 is assembled not limited to two positions A and B, and the small day wheel 243 could be rendered at three or four different positions.

The movement 20 incorporating this day display apparatus 200 is the same in both timepieces 2A and 2B, and thus offers the advantage of not requiring changing the arrangement of the day display apparatus 200 in order to change the model. Cost can thus be significantly reduced.

(2-10) Because the annular lever 233 overlaps the cam 232 through the thickness D of the timepiece 2A and 2B (FIG. 8), an increase in the thickness D of the timepiece 2A and 2B equal to this overlap between annular lever 233 and cam 232 is prevented in the middle of the main plate 20X. More particularly, because the cam 232 is contained within the opening 2342 in the annular lever 233, the plane position in which the annular lever 233 moves circularly and the plane position in which the cam 232 moves circularly can be located in substantially the same plane. The day display apparatus 200 is thus prevented from becoming particularly thick in the thickness direction D of the timepiece 2A and 2B, thereby affording a thin timepiece 2A, 2B. The strength of the annular lever 233 can also be increased by rendering opening 2342 in the annular lever 233 and disposing the lever in a ring surround the cam 232.

(2-11) Because day display apparatus 200, date display apparatus 290, and 24-hour display unit 190 all use the same center wheel 121 as the drive wheel, drive power from the center wheel 121 is reliably transferred to the day-turning wheel 212 and intermediate day wheel 231, and design efficiency is improved.

(2-12) A large space in which the annular lever 233 can be disposed can be assured from approximately the center to the outside edge of the main plate 20X as a result of rendering the rotary axis 20Z1 of the annular lever 233 near the center wheel 121 located at substantially the center of the main plate 20X.

Embodiment 3

A third embodiment of the present invention is described next.

This embodiment of the invention changes the diameter of the small day wheel 243 (FIG. 9) assembled at position A.

FIG. 11 is a schematic plan view of the day display apparatus 250 in this embodiment of the invention. This day display apparatus 250 can be used in timepiece 2A shown in FIG. 6 or timepiece 2B shown in FIG. 10.

Small day wheel 243 as described above is assembled at position B, or a small day wheel 245 that is larger in diameter than small day wheel 243 rendered at position B is disposed to position A. Note that both small day wheels 243 and 245 are shown in FIG. 11 for convenience describing this embodiment of the invention, but only one small day wheel 243 or 245 is used in an actual timepiece. The tooth form of small day wheel 245 is identical to the tooth form of small day wheel 243.

When the annular lever 233 moves circularly from the position indicated by the solid line in FIG. 11 to the position indicated by the double-dot dash line, the small day wheel 243 rendered at position B is moved circularly by engagement with the rack 235, and the day hand 242 attached to small day wheel 243 moves circularly. The angle of rotation of the day hand 242 in this case is the same 108° as in the first embodiment, and the angle of the fan shape of the display unit 241 corresponds to the 108° angle of rotation of the day hand 242 as in timepiece 2B shown in FIG. 10.

Because the diameter of the small day wheel 245 rendered at position A in FIG. 11 is greater than the diameter of small day wheel 243, the angle of rotation advanced by the rack 235 is less than the angle of rotation of small day wheel 243, and the angle of rotation of the day hand 242 attached to small day wheel 245 is 84°. Although the position on the dial 20A of the display unit 241 is the same as the timepiece 2A shown in FIG. 6, the angle of the fan shape of the display unit 241 corresponds to the 84° angle of rotation of the day hand 242.

This third embodiment of the invention affords the same effect as described in the second embodiment.

In addition, this embodiment affords even greater variation in the design of the dial 20A in timepieces 2A and 2B because the angle of rotation of day hand 242 and the angle of the fan shape of the display unit 241 differ. Yet further, this model change is afforded by changing only the diameter of the small day wheel 243, 245, and it is not necessary to change other aspects of the day display apparatus 250.

Embodiment 4

A fourth embodiment of the present invention is described next.

This embodiment of the invention changes the shape of the rack 235 on the annular lever 233 in the second embodiment.

FIG. 12 shows the day display apparatus according to this embodiment of the invention.

As shown in FIG. 12 the rack 335 of the annular lever 333 in this embodiment of the invention has a step that greatly changes the diameter of the arc portion of the rack 335. This step 335A renders a partial rack 3351 that meshes with the small day wheel 243 rendered at position A on the large diameter side of the step 335A, and a partial rack 3352 on the small diameter side of the step 335A that meshes with small day wheel 243 rendered at position B and has the same diameter as the rack 235 in the foregoing second [first, sic] embodiment of the invention. These partial racks 3351, 3352 are rendered with the same tooth form, a tooth row of substantially equal length, and at the same axis of rotation around rotary axis 20Z1.

It should be noted that the profiles of partial racks 3351, 3352 do not follow the outside edge of the main plate 20X because the curved partial racks 3351, 3352 pivoting around rotary axis 20Z1 are not rendered concentrically to the round main plate 20X with center wheel 121 at the center. However, because the large diameter partial rack 3351 positions the small day wheel 243 assembled to position A near the edge of the main plate 20X, the distance D1 (FIG. 13) from the axis of small day wheel 243 at position A to the edge of the opening in the case member 11 (including here and below to the edge of the spacer <?> if a spacer is provided) is substantially equal to the distance D2 (FIG. 14) from the axis of the small day wheel 243 at position B to the edge of the opening in the case member 11, and the small day wheel 243 can thus be rendered along the edge of the main plate 20X whether at position A or position B.

Rendering the small day wheel 243 at position A in this day display apparatus 300 results in timepiece 3A as shown in FIG. 13.

Because the large diameter partial rack 3351 is used in this timepiece 3A, circular movement of the partial rack 3351 advances the small day wheel 243 a greater distance and thus increases the angle of rotation of the day hand 242 attached to the small day wheel 243. The angle of rotation of the day hand 242 is 122° in this embodiment of the invention, and the fan angle of the 341 corresponds to this 122° angle.

Rendering the small day wheel 243 at position B in this day display apparatus 300 results in timepiece 3B as shown in FIG. 14. In timepiece 3B [2B, sic] the small day wheel 243 is advanced by circular movement of the partial rack 3352 the same distance as the small day wheel 243 is advanced by the rack in the second [first, sic] embodiment. The angle of rotation of the day hand 242 is thus the same 108° angle of rotation in the first embodiment, and the fan angle of the display unit 241 is also an angle corresponding to this 108° angle.

As with the foregoing second embodiment, variations in the appearance of the dial 20A can be easily rendered in different timepiece models 3A, 3B because the positions of the display unit 241, 341 and the angle of the fan shape of the display unit 241, 341 are different in timepieces 3A and 3B.

As also described above, because the large diameter partial rack 3351 disposes the small day wheel 243 near the edge of the main plate 20X at position A and position B, the distance D1 from the open edge of the case member 11 to the rotational axis of the day hand 242 in timepiece 3A, and the distance D2 from the open edge of the case member 11 to the rotational axis of the day hand 242 in timepiece 3B, are substantially equal, and timepieces 3A and 3B can be similarly designed.

This fourth embodiment of the invention affords the same effects as the preceding embodiments. This embodiment of the invention enables offering different models of timepieces 3A, 3B by simply changing the location of the small day wheel 243 without requiring changing other aspects of the day display apparatus 300.

Variations of this embodiment of the invention could have three or more partial racks, and the small day wheel 243 could thus be located at three or more locations corresponding to the number of partial racks. This affords even more design variations by changing the position of the display unit 241.

Embodiment 5

A fifth embodiment of the invention is described next.

This embodiment of the invention changes the tooth form of one partial rack in the foregoing fourth embodiment.

FIG. 15 is a plan view of the day display apparatus 350.

The tooth form of the large diameter partial rack 3551 is different from the tooth form of partial rack 3352, and the tooth pitch of partial rack 3551 is greater than the tooth pitch of partial rack 3352 in the annular lever 353 according to this embodiment of the invention. A small day wheel 347 that is larger in diameter than small day wheel 243 and has the same tooth pitch as partial rack 3551 therefore meshes with partial rack 3551.

While partial rack 3551 is thus larger in diameter than partial rack 3352, the diameter of the corresponding small day wheel 347 is also larger and circular movement of partial rack 3551 advances small day wheel 347 the same distance as partial rack 3352 advances small day wheel 243. In other words, the angle of rotation of the day hand 242 attached to small day wheel 243 is the same as the angle of rotation of the day hand 242 attached to small day wheel 347.

FIG. 16 shows a timepiece 3C having small day wheel 347 assembled at position A, and FIG. 17 shows a timepiece 3D having small day wheel 243 assembled at position B. Note that the appearance of timepiece 3D is identical to the appearance of timepiece 3B shown in FIG. 14.

As will be known from these figures, the fan angle of the display unit 241 is the same in timepieces 3C and 3D, and timepieces 3C and 3D have the same design. Because the angle of rotation of day hand 242 is the same in both timepieces as noted above, the fan angle of display unit 241 is an angle corresponding to the angle of rotation of day hand 242.

Furthermore, as in the fourth embodiment, distances D1 and D2 from the open edge of the case member 11 to the rotary axis of the day hand 242 are the same in timepieces 3C and 3D.

This embodiment affords the same effects as the preceding embodiments.

Variation 1

The present invention shall not be limited to the foregoing embodiments and can be varied in many ways without departing from the scope of the present invention.

FIGS. 18A and 18B, and FIGS. 19A and 19B show timepieces 4A, 4B, 4C, and 4D according to variations of the present invention. These timepieces 4A to 4D differ in the design of the dial 20A and all use the same movement.

Timepieces 4A to 4D have the day display apparatus 350 shown in FIG. 15 and described above, and a date display apparatus 380 as another retrograde display, and thus have a plurality of retrograde display mechanisms for displaying the day and date.

This day display apparatus 350 enables assembling the small day wheel 243, 347 (FIG. 15) at the 9:30 and 8:30 positions. The date display apparatus 380 enables assembling date star wheel not shown at the 2:30 and 3:30 positions.

The location of the small day wheel 243, 347 in the day display apparatus 350 and the location of the date star wheel in the date display apparatus 380 can thus be combined in four different ways corresponding to timepieces 4A to 4D. More specifically, four different designs can be easily achieved by simply changing the positions of the small day wheel 243, 347 and date star wheel.

It will also be obvious that the pinion of the display apparatus could be rendered at three or more locations, and three or more display apparatuses according to the present invention can be provided, thus creating even more design variations.

In this variation of the invention date display apparatus 380 is used instead of the date display apparatus 290 driving date hand 294 as shown in FIG. 7. This date display apparatus 380 is composed of center wheel 121, date-turning wheel 292, and date star wheel 293 used in date display apparatus 290 where date-turning wheel 292 functions as an intermediate wheel and date star wheel 293 is formed in unison with the cam as a follower. Cam rotation causes the lever to move circularly, and the rack on the lever advances the pinion to display the date. Because this date display apparatus 380 is compact like the day display apparatus 350 and its footprint on the main plate 20X differs little from the date display apparatus 290, replacing date display apparatus 290 with date display apparatus 380 makes it simple to change from a display indicating the date with a rotating hand to a display indicating the date with a retrograde hand.

More specifically, this embodiment of the invention makes it possible to provide a timepiece having an in-dial date display as shown in FIG. 6 by using date display apparatus 290 or a timepiece having a retrograde date display as shown in FIG. 18 and FIG. 19 by using date display apparatus 380 while the movement 20 in which date display apparatus 290 or 380 is incorporated is the same. A variety of display designs are thus easily afforded at low cost, and this aspect of the invention is particularly useful for developing different models of timepieces.

Variation 2

FIG. 20 is a plan view of a day display apparatus 400 in another variation of the present invention. The lever 133, 233, 333, 353 in each of the preceding embodiments is formed in a ring. In this aspect of the invention, however, the lever 433 of the day display apparatus 400 is formed curving substantially in a C-shaped configuration around the cam 232. This lever 433 is pivotally supported at one end at rotary axis 20Z1 and is composed of a lever portion 434 at one end formed in unison with a rack 235 that meshes with small day wheel 243. The lever portion 434 has a detent 2341 that contacts the cam 232. The lever portion 434 and rack 235 could also be separate members.

Insofar as this lever of the present invention curves around the cam, the lever could be a ring-shaped member as described in the foregoing embodiments of the invention, a C-shaped member as in this second variation of the invention, an S-shaped member, an L-shaped member, or other configuration having a detent that contacts a cam located on the inside of the curve.

By using a drive wheel, driven wheels, cam, lever, rack, pinions, and indicating members (hands) as described above, the present invention affords great freedom of design and layout without complicating the construction. Depending upon how the drive wheel, driven wheels, cam, lever, rack, pinions, and hands are arranged, the display units can be disposed so that the center of the fan-shaped arc is disposed in the central portion of the dial and the hands point from the center to the outside of the dial in the direction opposite that of the display apparatus 100 shown in FIG. 3, for example. The angle and size of the fan shape of the display unit can be determined as desired according to the range of movement of the hands and the configuration of the display unit scales.

While display unit 141 is rendered on the 12 o'clock side of the center wheel 121 and display unit 181 is rendered on the 6 o'clock side in the foregoing first embodiment, the invention shall not be so limited.

The shape of the cam, lever, and rack can also be determined as desired. For example, the day follower could have 14 teeth and be advanced one tooth per day, and the cam could have two peaks. When thus arranged the cam turns one revolution every two weeks, and the hand reciprocates twice when this cycle repeats twice. The cam could alternatively have three peaks and rotate once every three weeks, or have four peaks and rotate once every four weeks.

The indicating members of the present invention shall not be limited to conventional hands such as shown in the accompanying figures, and could feature figurines, flowers, animals, or cartoon characters, for example.

The shape of the display unit could also be indicated only by the fan-shaped arc.

A conventional ring-shaped rotating wheel (such as a date wheel or day wheel) can also be used in conjunction with the present invention to display calendar information and the time. The date could be displayed with a rotating wheel, for example, while the month and day are displayed in a display unit according to the present invention. When thus arranged, the drive wheel, driven wheels, and other components can be easily incorporated on the inside circumference part of the rotating wheel.

Calendar information is displayed in the preceding embodiments by means of a retrograde date display apparatus or day display apparatus, but the invention can also be used to provide other types of calendar information such as the month or year, moon or astrological phases, or time information such as the hour, minute, or second. In such cases the speed reduction or acceleration ratio of the drive wheel, driven wheel, rack, and pinion is appropriately determined so that the wheels advance according to the displayed information.

A plurality of display apparatuses according to the present invention could also be disposed to present two, three, four, or more retrograde displays for the desired calendar or time information, such as the month and day, the day and date, or other combination of information in retrograde displays.

Furthermore, in each of the preceding embodiments the lever and rack are formed in unison, or the lever, rack, and urging means are formed in unison, but the invention shall not be so limited and the lever, rack, and urging means can be separate members. For example, the lever could be substantially V-shaped, the rack could be formed in an arc overlapping the V shape of the lever, and this lever and rack could be fixed together coaxially. By rendering the cam on the inside of this lever, the cam and lever will rotate or move circularly in substantially the same plane, thus affording a thin display apparatus.

The follower is also disposed on the main plate and the cam and lever are disposed on an opposing pressure plate in the foregoing embodiments of the invention. The invention shall not be so limited, however, and the lever, rack, and cam could be rendered on the main plate while the follower is rendered on the pressure plate.

The position of the pivot point, the angle of rotation, and the direction indicated by the day hand 242, and the circular center O of the fan shape and the fan angle of the display unit 241, are described by way of example in the second and other embodiments above, but the location of the pivot point, the angle of rotation, and the direction indicated by the indicating member, and the circular center of the fan shape and the fan angle of the display unit, can be arranged as desired.

More specifically, the pivot point and angle of rotation of the hand (indicating member) are determined according to the diameter, tooth form, and tooth count of the pinion and rack as described in the preceding embodiments of the invention. In addition, the direction indicated by the hand is determined by the relative positions of the assembled pinion, lever, and cam.

In the second and other embodiments described above the small day wheel 243 of the day display apparatus 200 can be located at one of two positions A and B, but the invention shall not be so limited as the pinion could be rendered at one of three or more locations. This affords manufacturing an even greater number of models.

Yet further, the rotary axis 20Z1 of the annular lever 233 is disposed near the center wheel 121 in the second and other embodiments described above, but the invention shall not be so limited. More particularly, the rotary axis 20Z1 of the annular lever 233 could be disposed near the edge of the main plate 20X or between the center wheel 121 and edge of the main plate 20X as desired.

Furthermore, one rack 235 is formed on the curved portion of the annular lever 233 in the second and other embodiments described above, and the small day wheel 243 can be located at a plurality of positions A, B along the rack 235, but the invention shall not be so limited. More particularly, as described in the fourth and fifth embodiments, the small day wheel could be located at a plurality of locations and a plurality of rack portions could be provided according to the number of small day wheel positions. If the plural rack portions have a different diameter or tooth form, the angle of rotation of the pinion and indicating member will also differ, and different designs can be rendered in different models. The same effect can also be achieved by changing the diameter of the pinion instead of changing the diameter of the rack portion as described in the third embodiment.

The opening 2342 formed in the annular lever 233 in the second and other embodiments described above is a through-hole and the annular lever 233 is formed in a ring, but the opening in the lever shall not be limited to a through-hole and could be a recess (blind hole).

By appropriately selecting where the pinion is located, the display apparatus of the present invention can also be rendered in a movement in which the pinion can be selectively located at one of plural positions according to the available space on the main plate, for example, but only one pinion can be provided at one of plural locations due to space limitations. In other words, models having a retrograde display function rendered by the display apparatus of the present invention can be easily added to a line of products.

The best modes and methods of rendering the present invention are described above, but the invention shall not be limited thereto. More specifically, the invention has been described and shown in the figures with reference to specific embodiments thereof, but the shapes, materials, quantities, and other aspects of the foregoing embodiments can be varied in many ways by one with ordinary skill in the related art without departing from the scope of the accompanying claims.

The shapes, materials, and other aspects of the foregoing embodiments are thus described by way of example only to help better understand the present invention and the invention shall not be limited thereto, and descriptions using part names that remove part or all of these shape, material, and other limitations shall also be included within the scope of the present invention.

FIELD OF INDUSTRIAL APPLICABILITY

The present invention thus described simplifies the arrangement of a timepiece having a retrograde display and greatly improves the degree of freedom of design.

Figure 1:
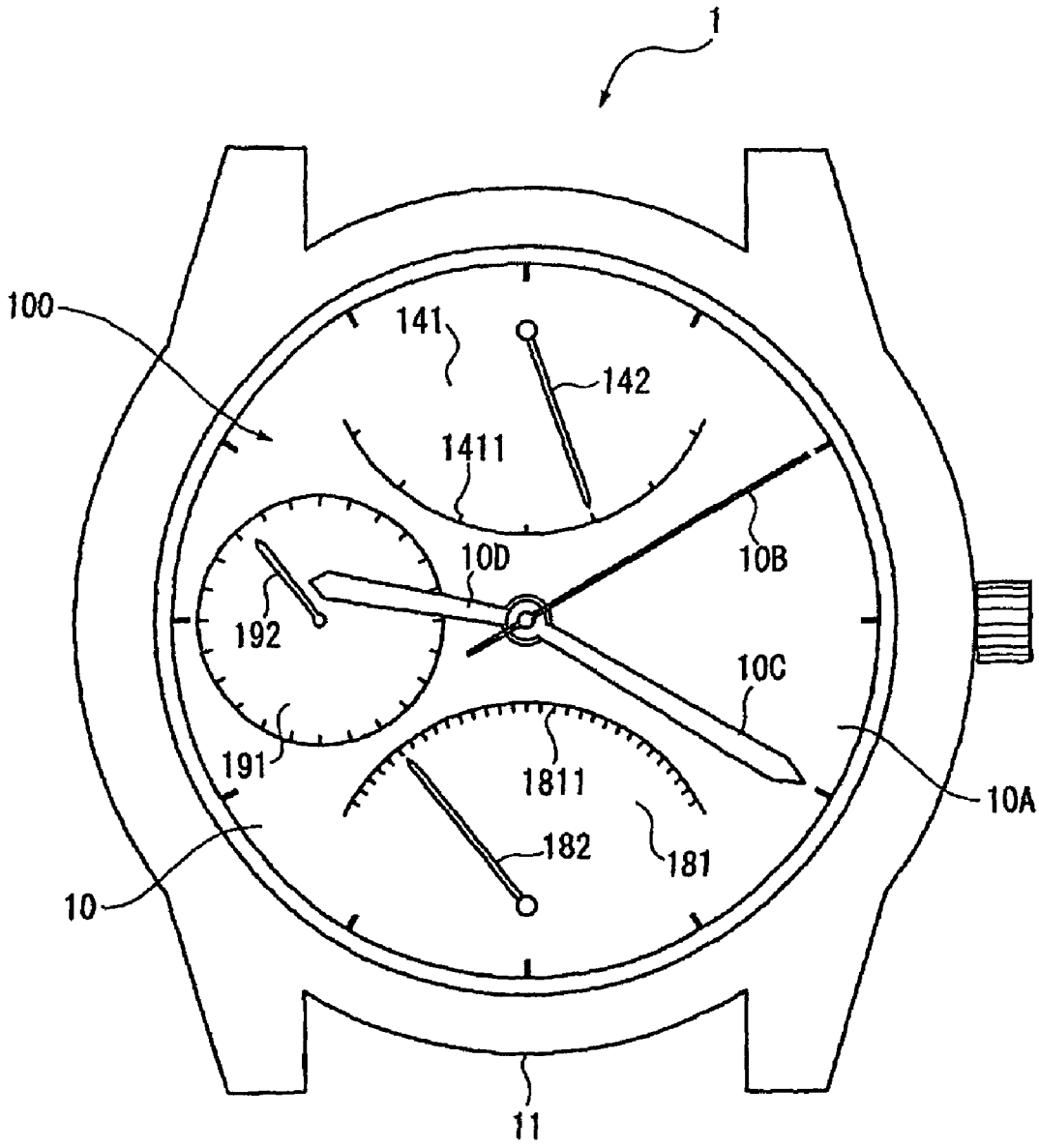
FIG. 1 is a plan view showing the appearance of a timepiece according to a first embodiment of the present invention.
Figure 2:
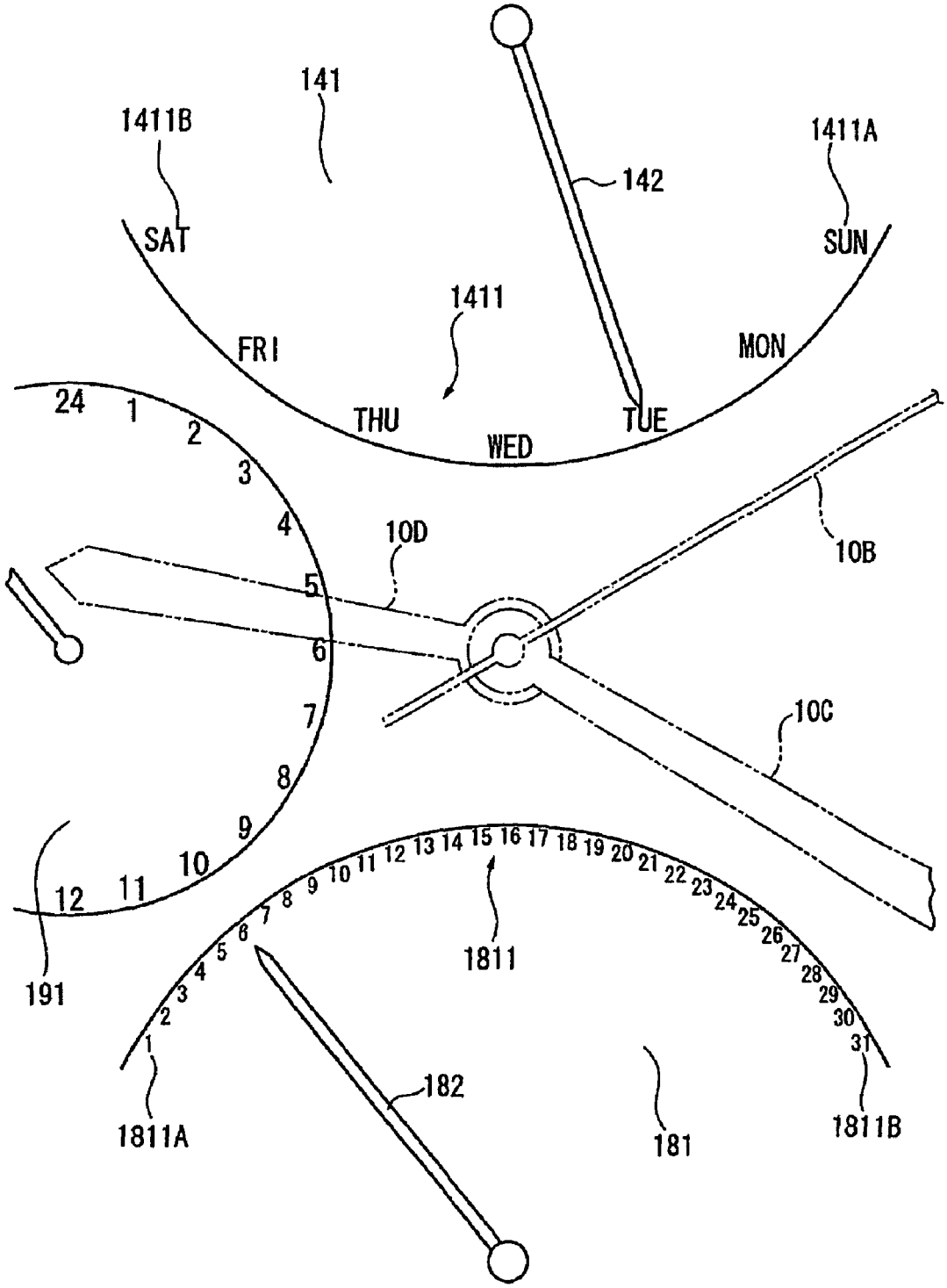
FIG. 2 is an enlarged view of a portion of FIG. 1.
Figure 3:
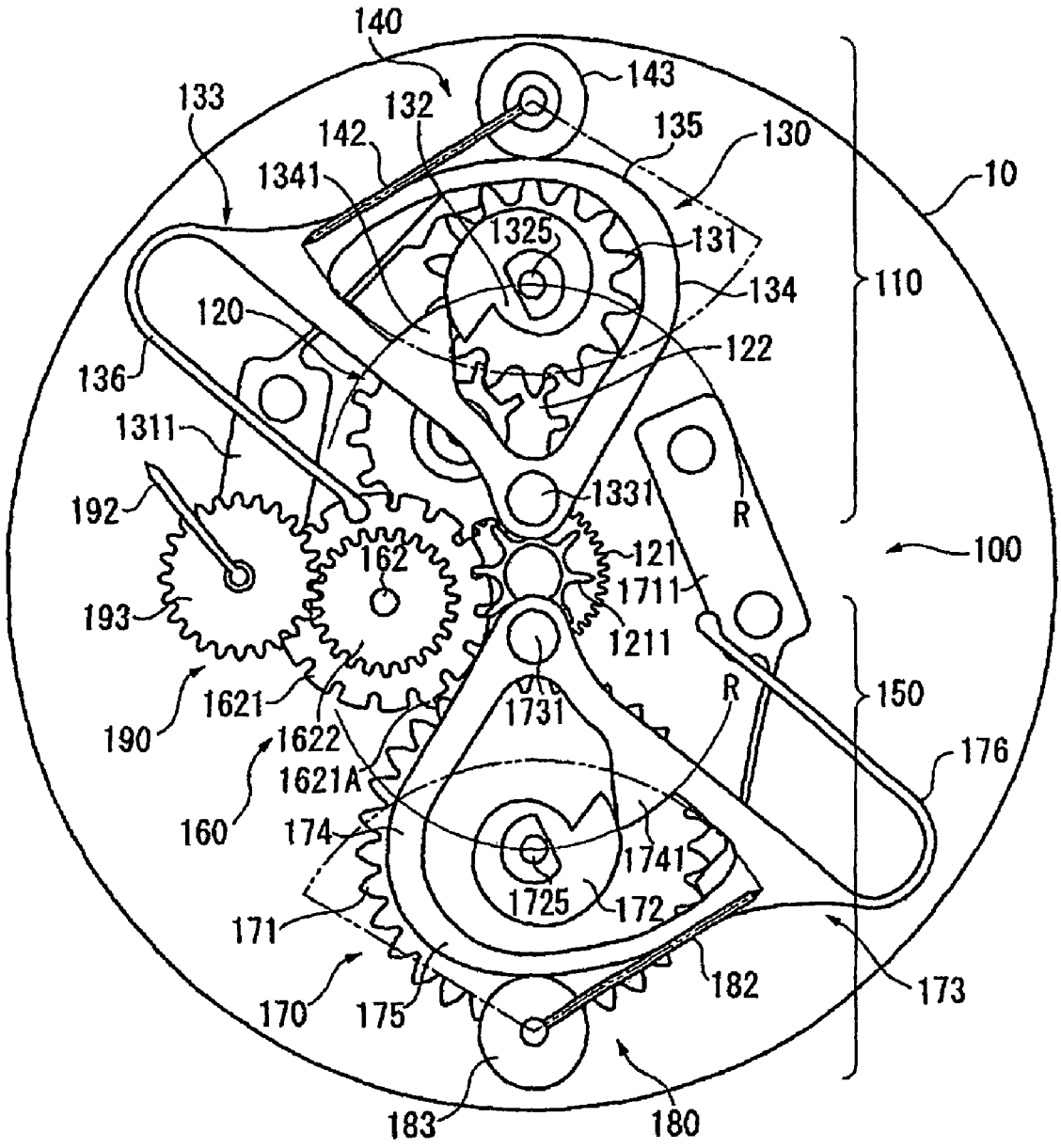
FIG. 3 is a plan view showing the display apparatus of a timepiece according to the first embodiment of the present invention.
Figure 4:
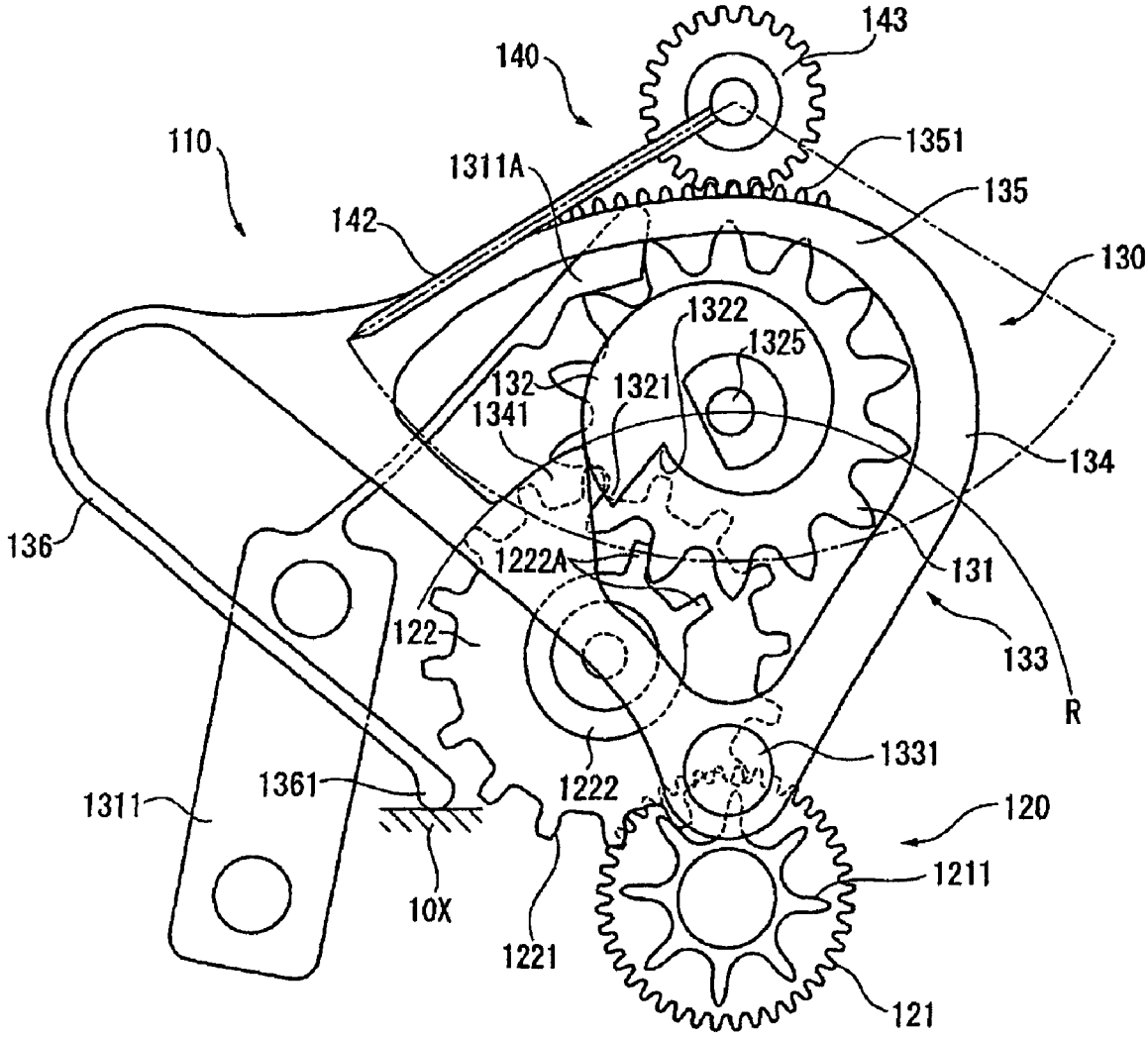
FIG. 4 is a plan view showing the day display unit in the first embodiment of the invention.
Figure 5:
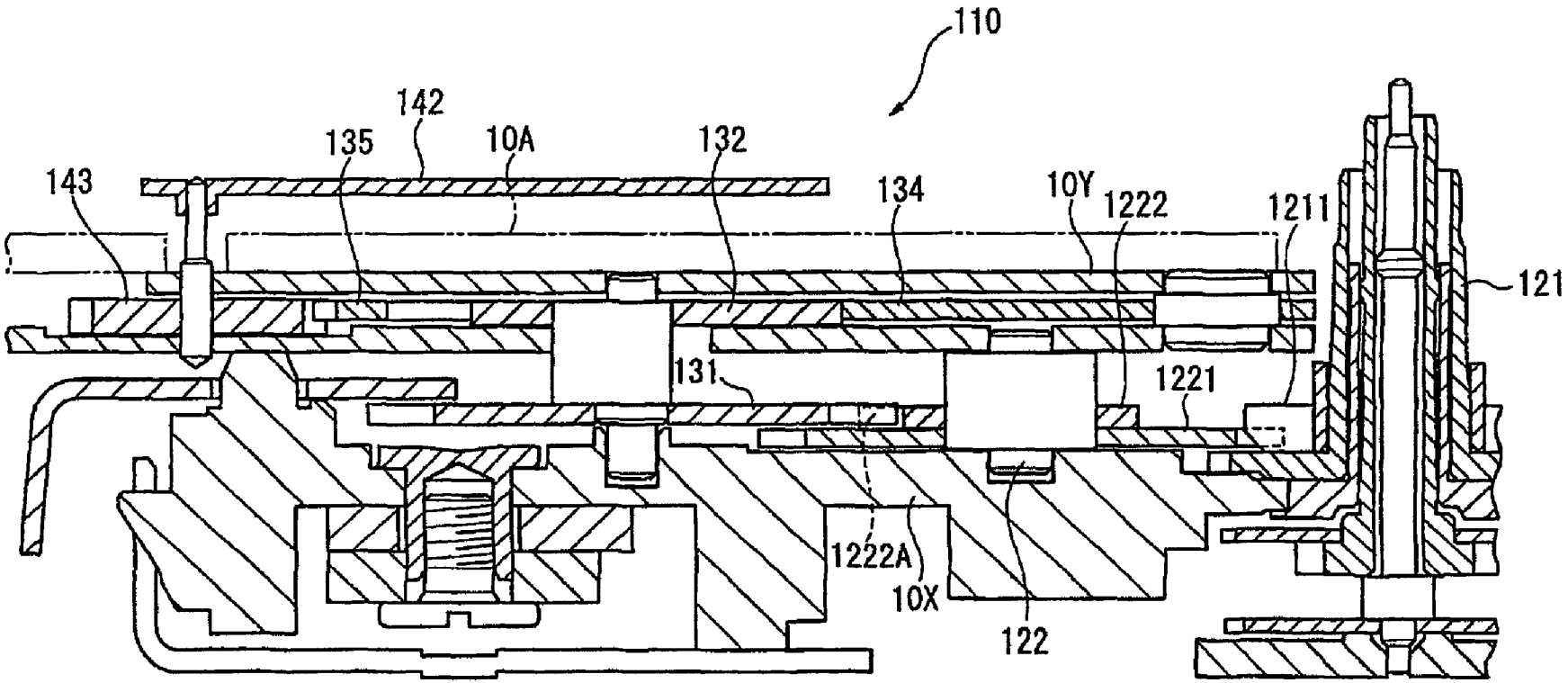
FIG. 5 is a section view showing the day display unit in the first embodiment of the invention.
Figure 6:
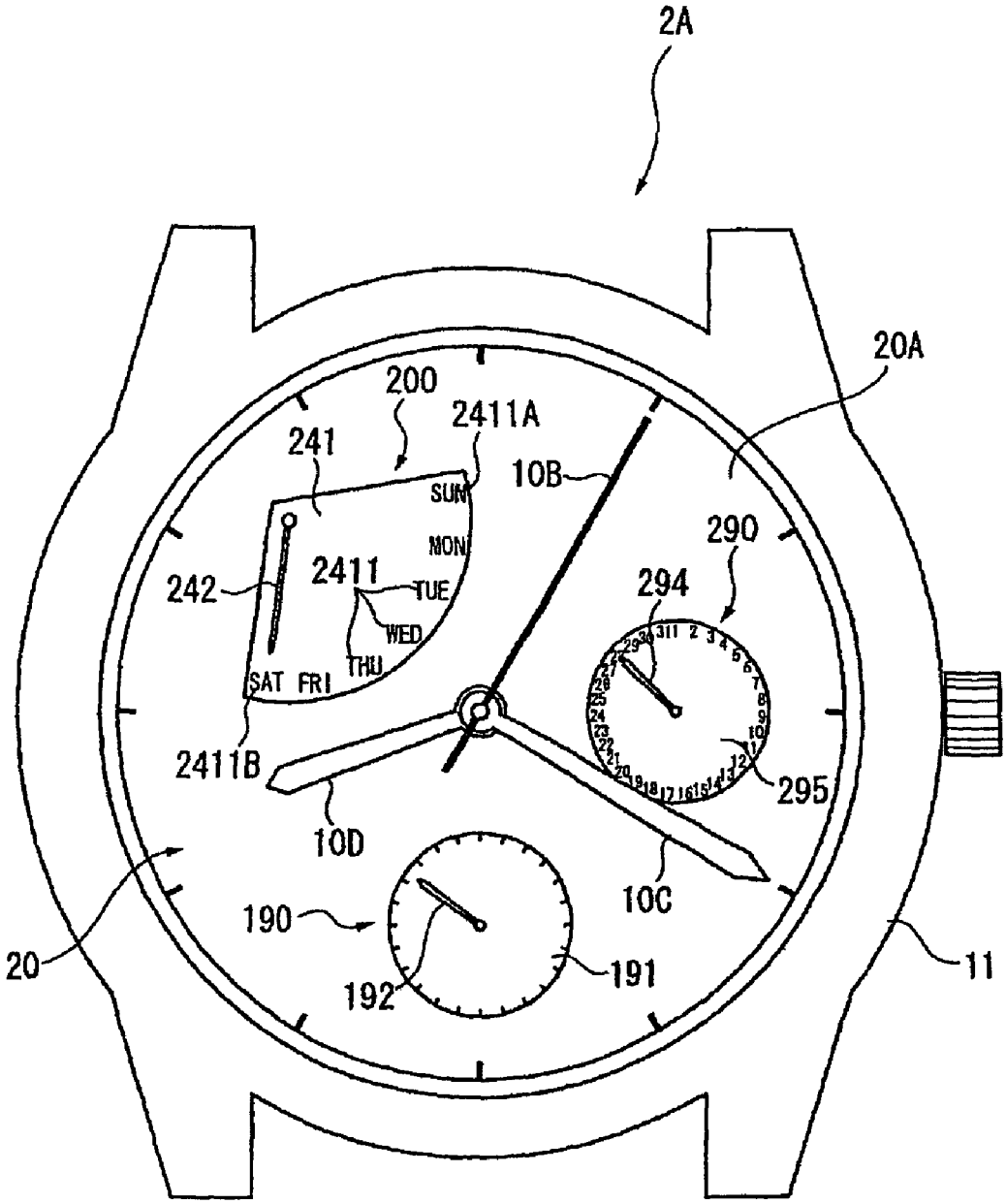
FIG. 6 is a plan view showing the appearance of a timepiece according to a second embodiment of the present invention.
Figure 7:
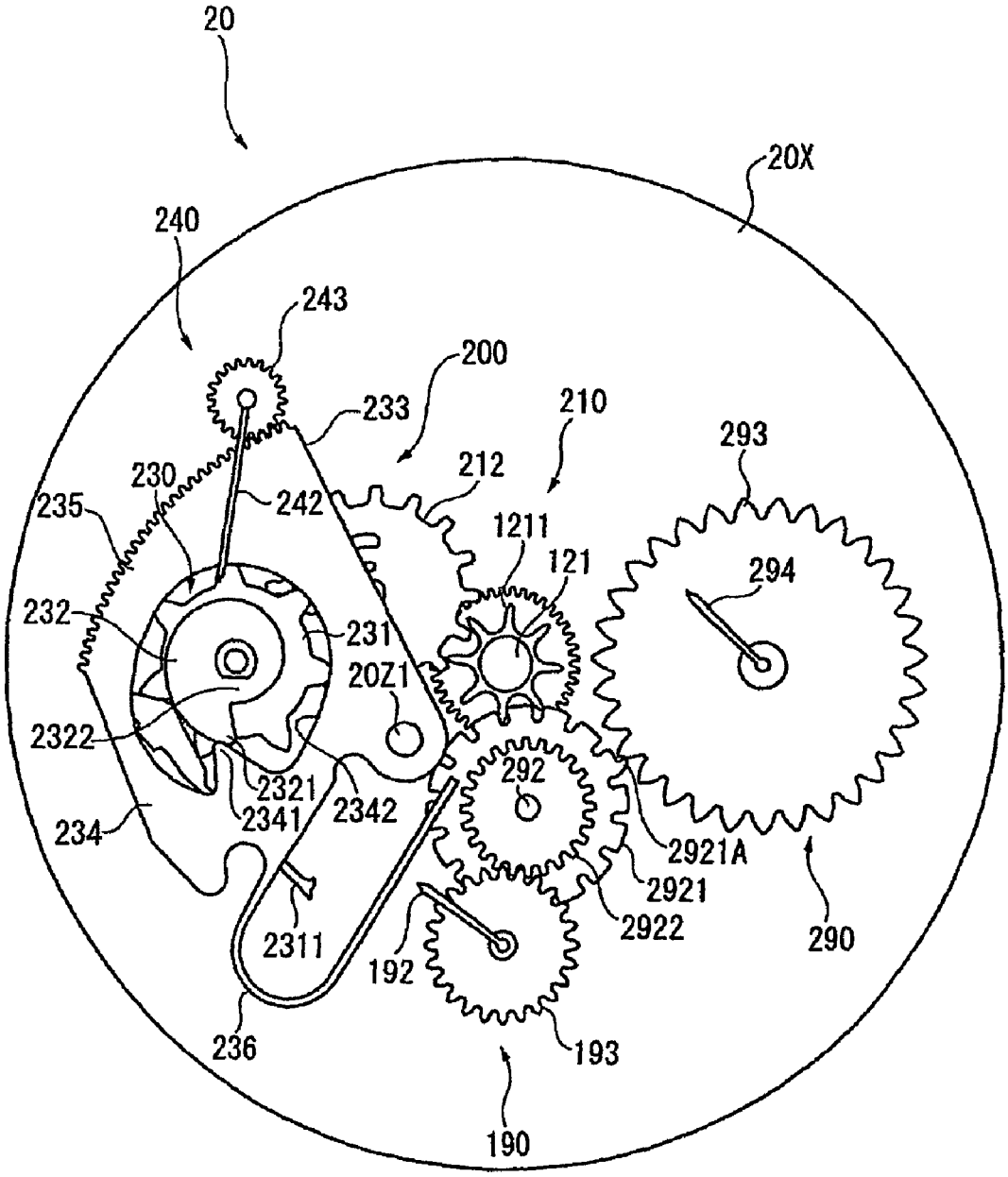
FIG. 7 is a plan view showing the movement in a timepiece according to the second embodiment of the present invention.
Figure 8:
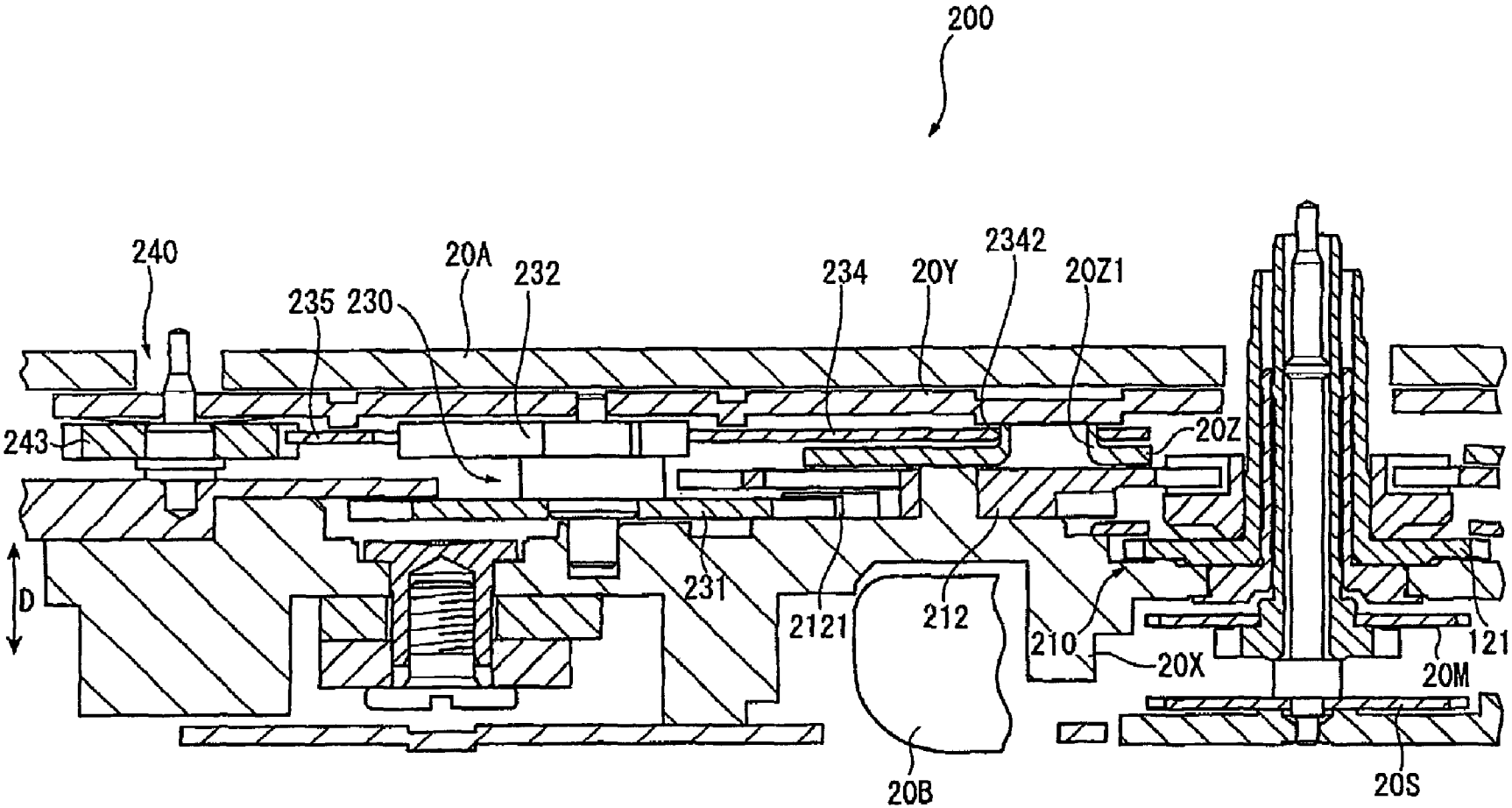
FIG. 8 is a section view showing major parts of the movement in a timepiece according to the second embodiment of the invention.
Figure 9:
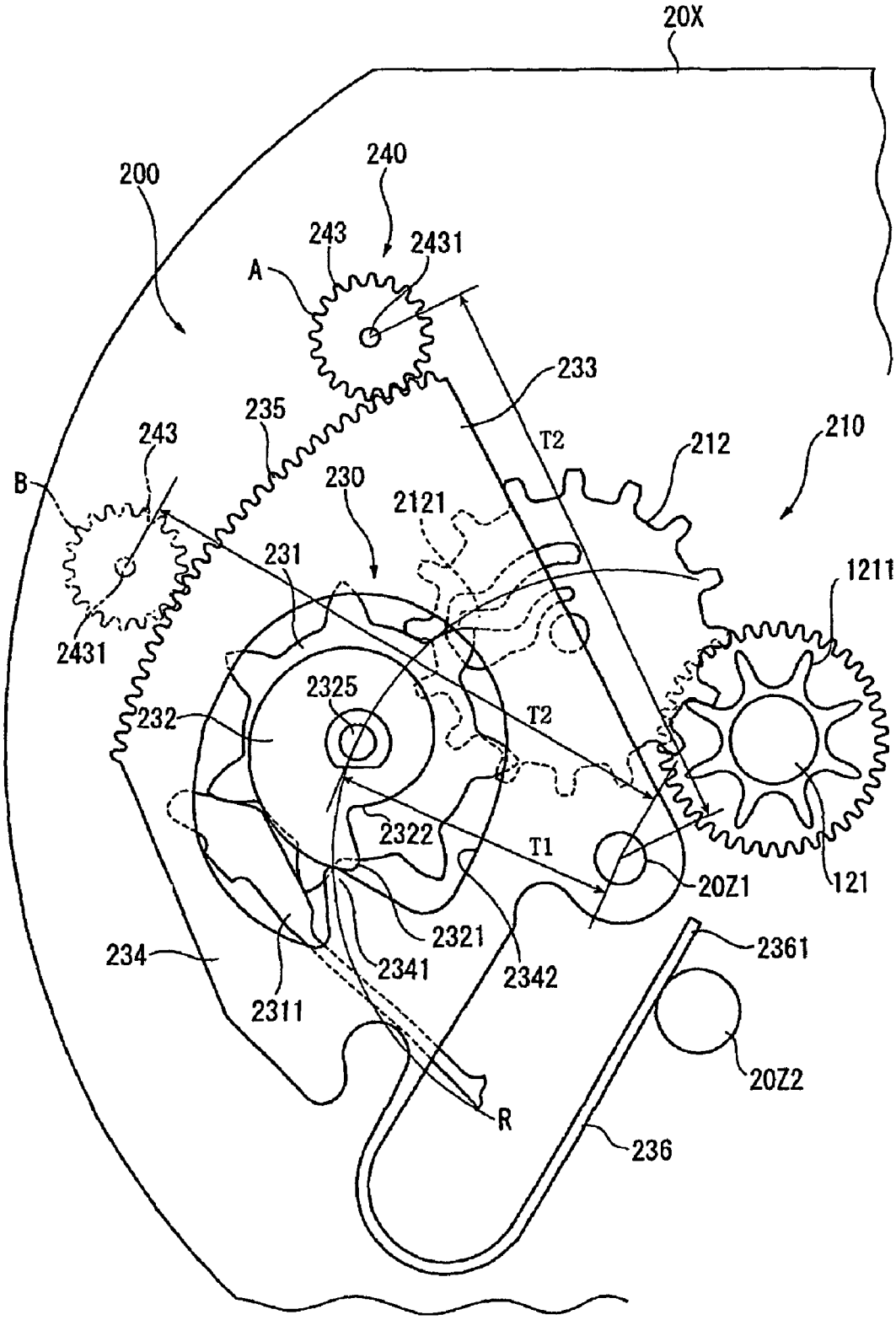
FIG. 9 is an enlarged plan view of part of FIG. 7 showing the display unit in a timepiece according to the second embodiment of the invention.
Figure 10:
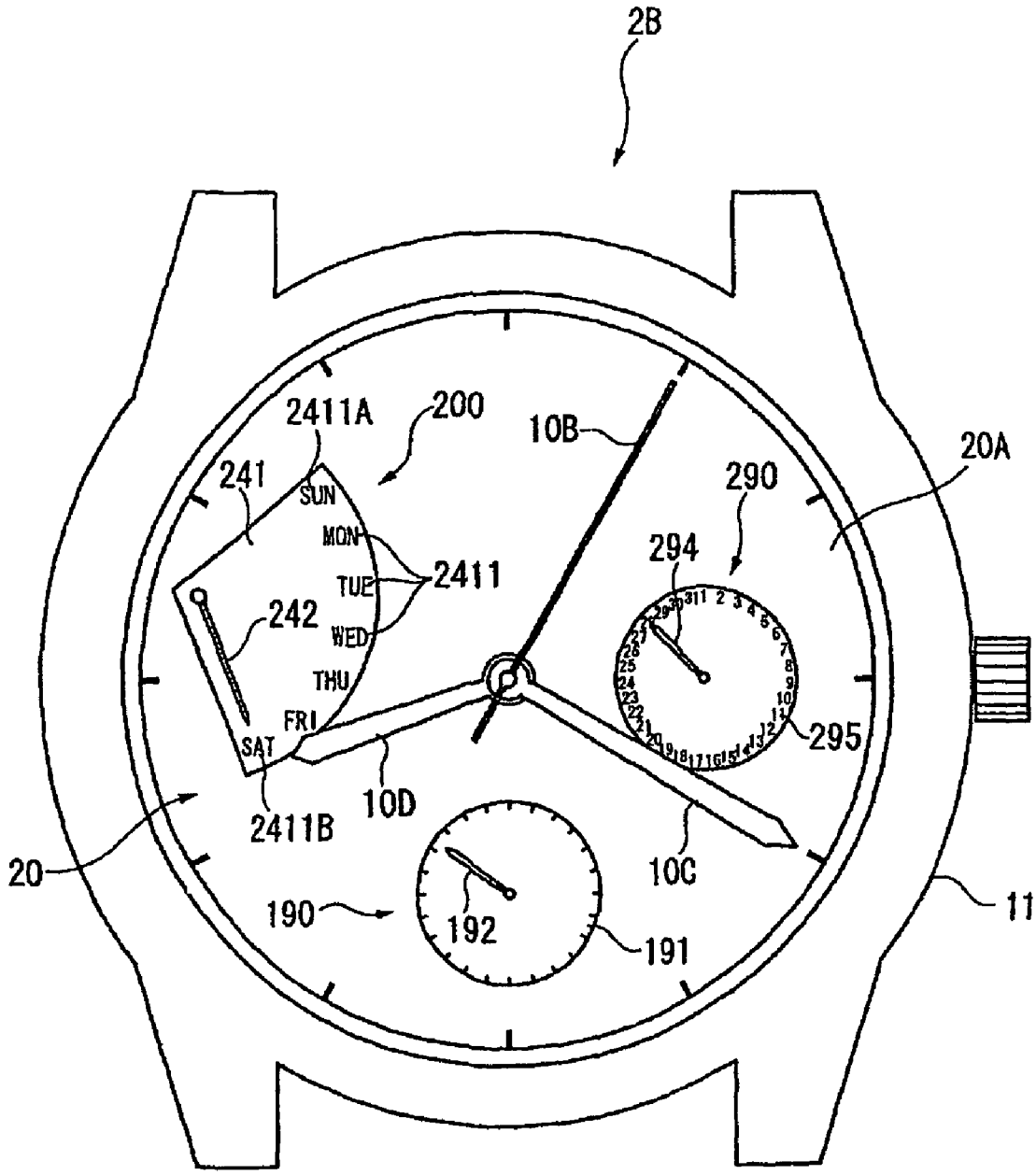
FIG. 10 is a plan view showing the appearance of another model of a timepiece according to the second embodiment of the invention.
Figure 11:
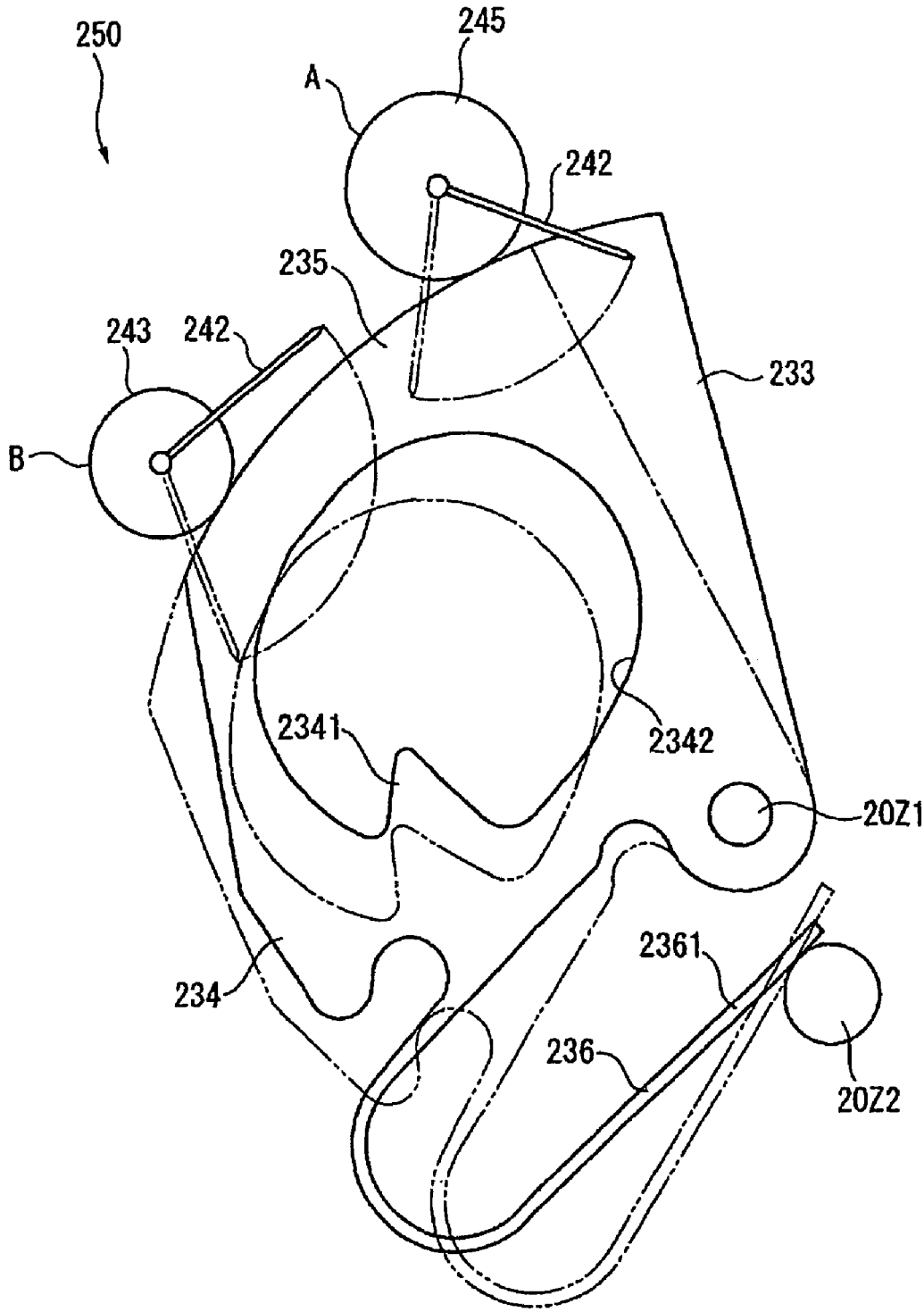
FIG. 11 is a schematic plan view showing the display unit in a timepiece according to a third embodiment of the invention.
Figure 12:
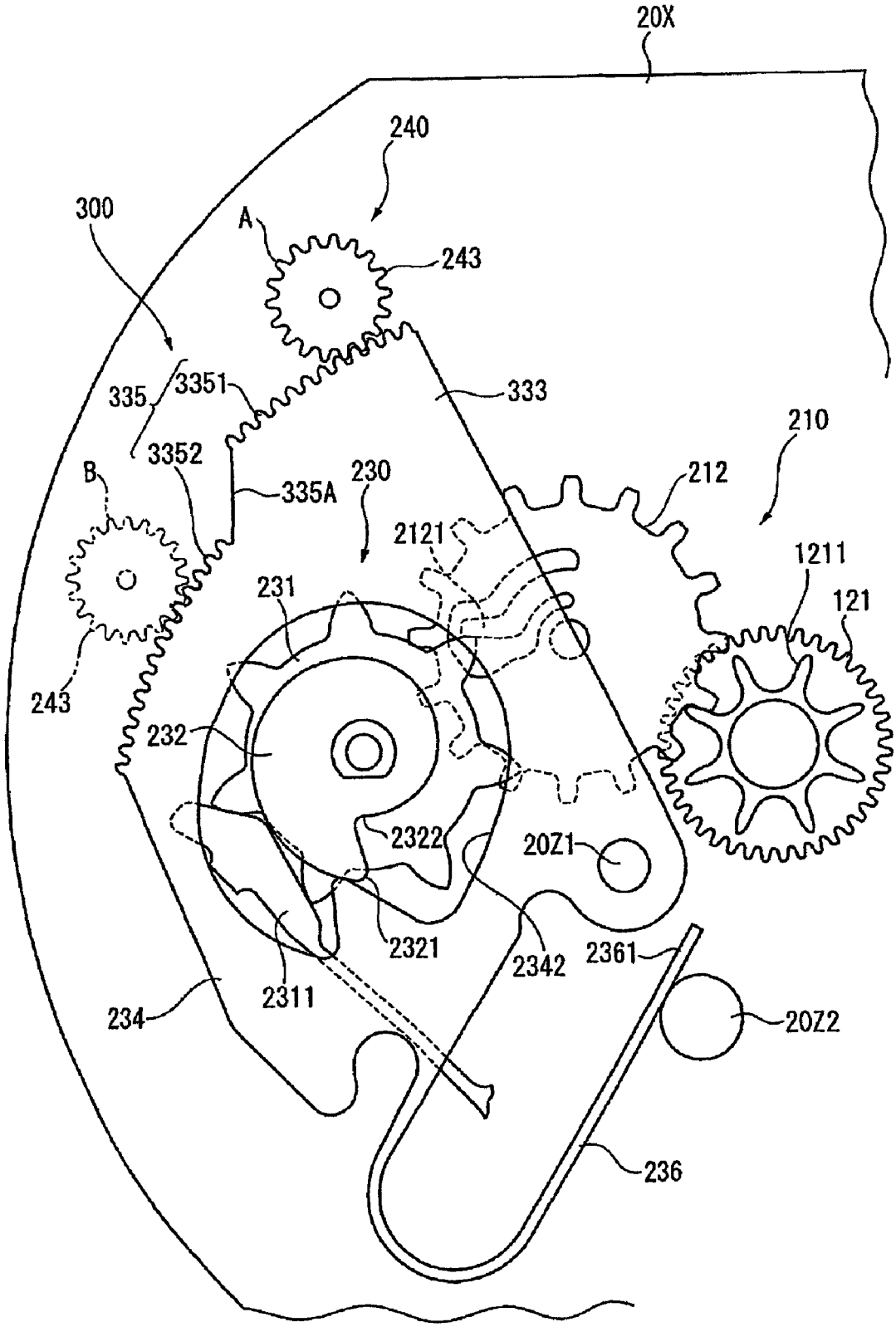
FIG. 12 is a plan view showing the display unit of a timepiece according to a fourth embodiment of the invention.
Figure 13:
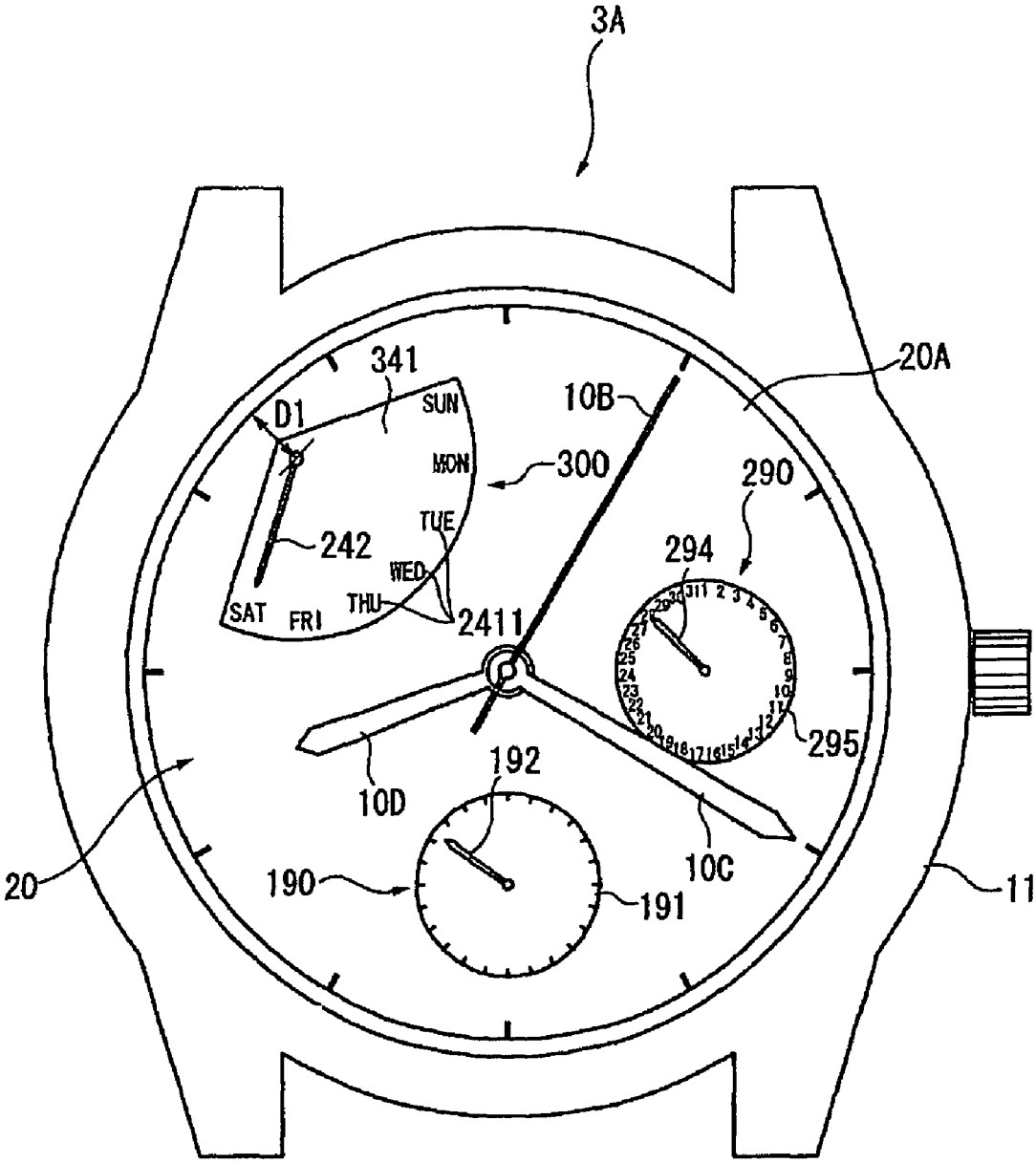
FIG. 13 is a plan view showing the appearance of a timepiece according to the fourth embodiment of the invention.
Figure 14:
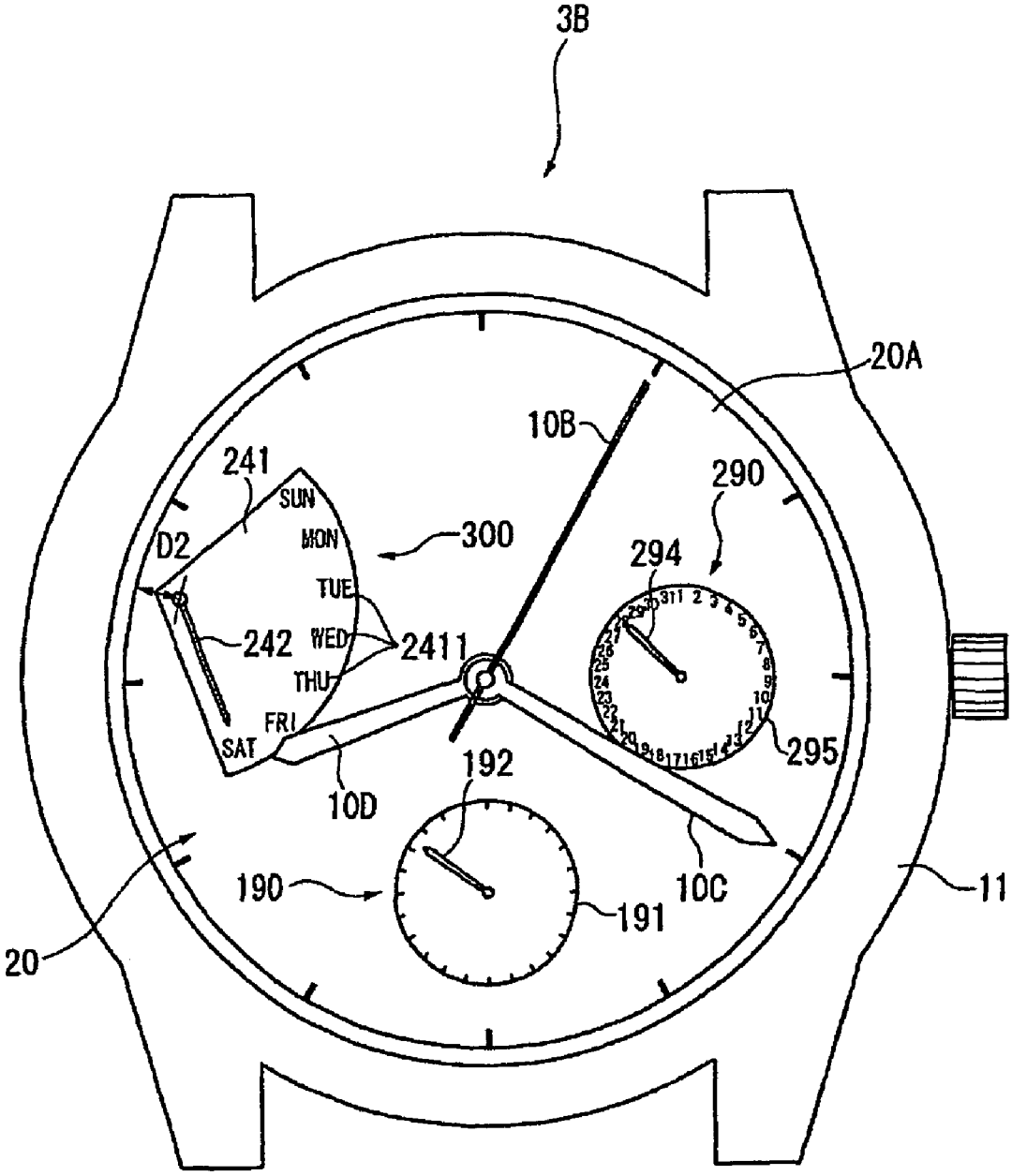
FIG. 14 is a plan view showing the appearance of another model of a timepiece according to the fourth embodiment of the invention.
Figure 15:
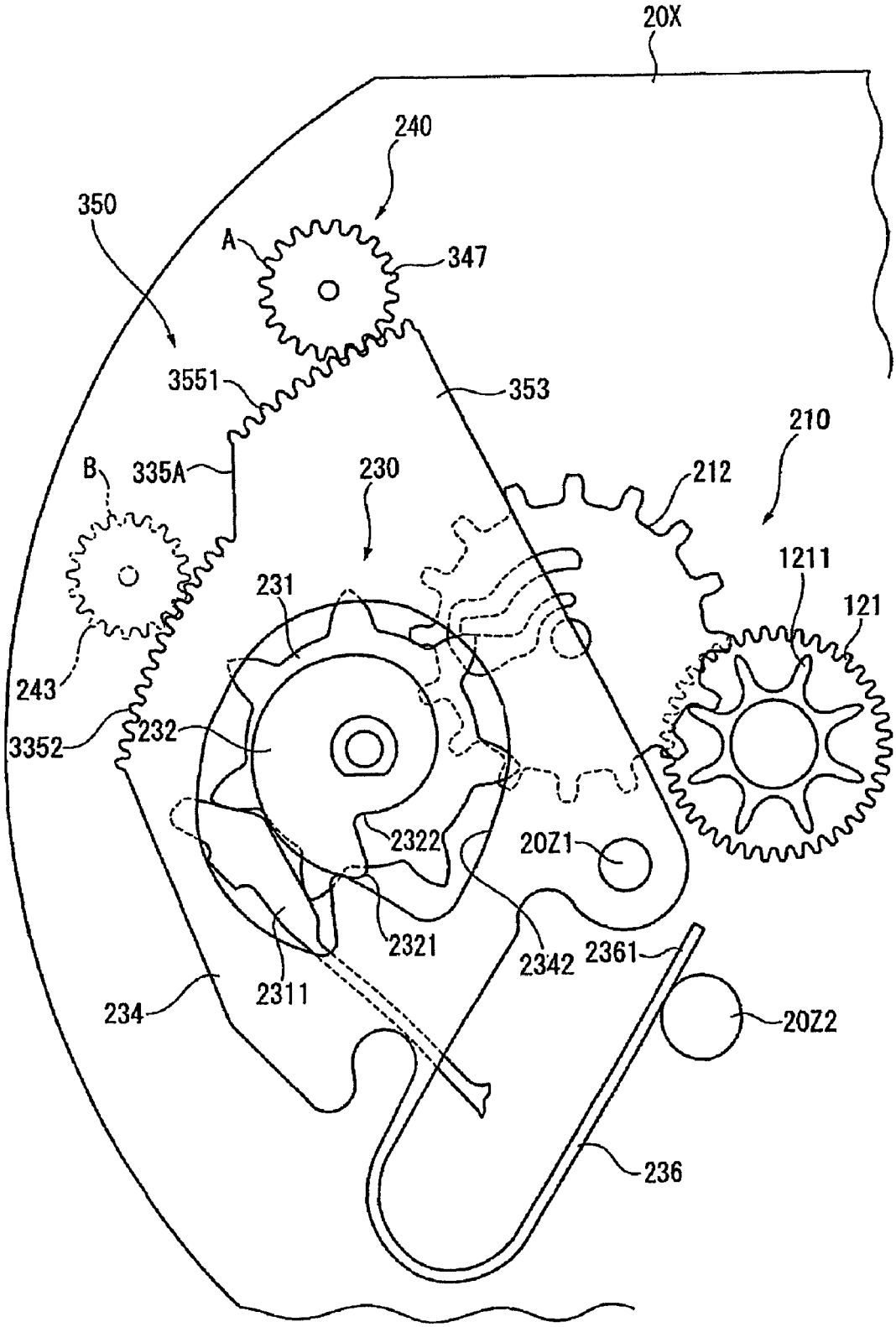
FIG. 15 is a plan view showing the display unit of a timepiece according to a fifth embodiment of the invention.
Figure 16:
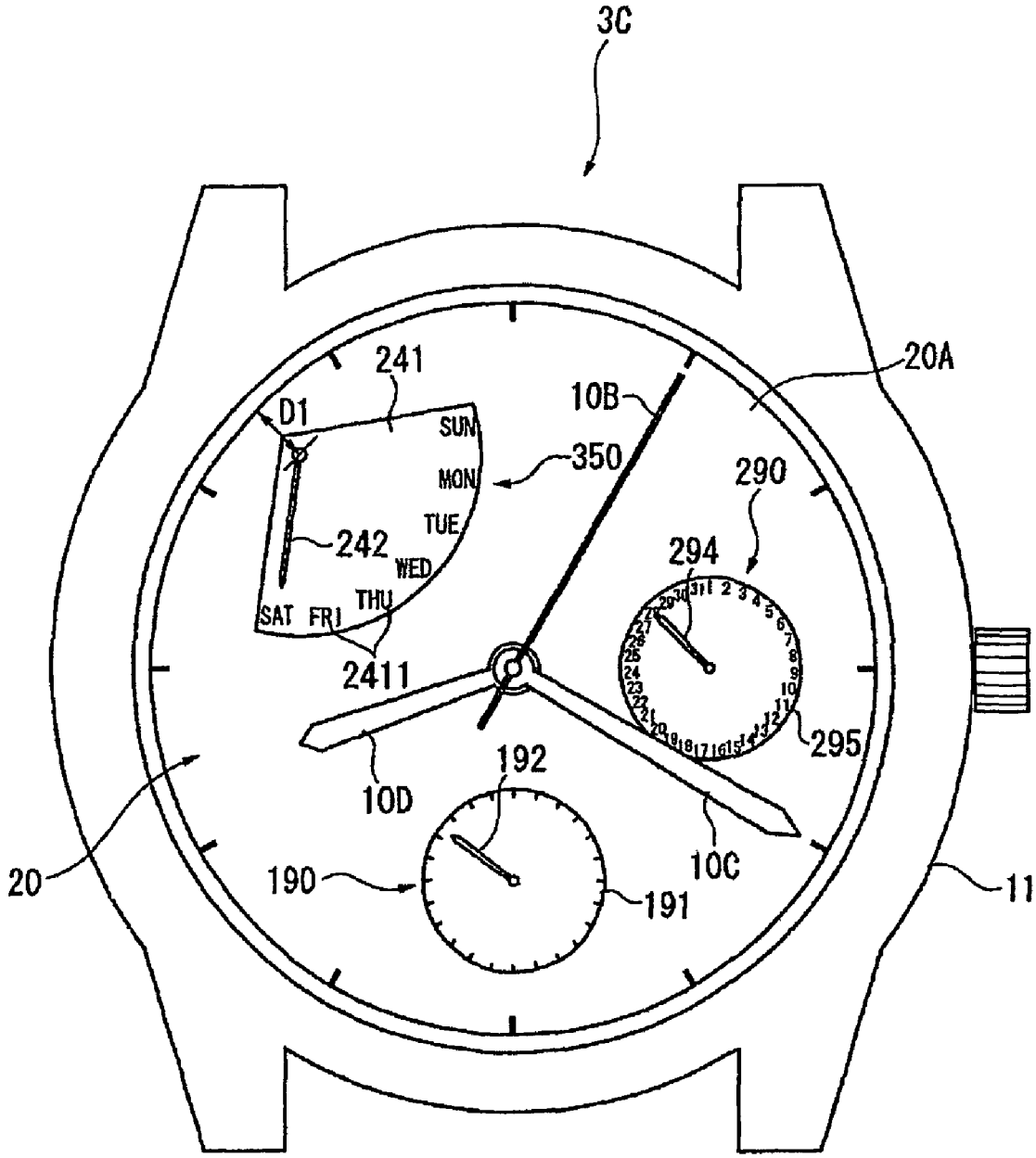
FIG. 16 is a plan view showing the appearance of a timepiece according to the fifth embodiment of the invention.
Figure 17:
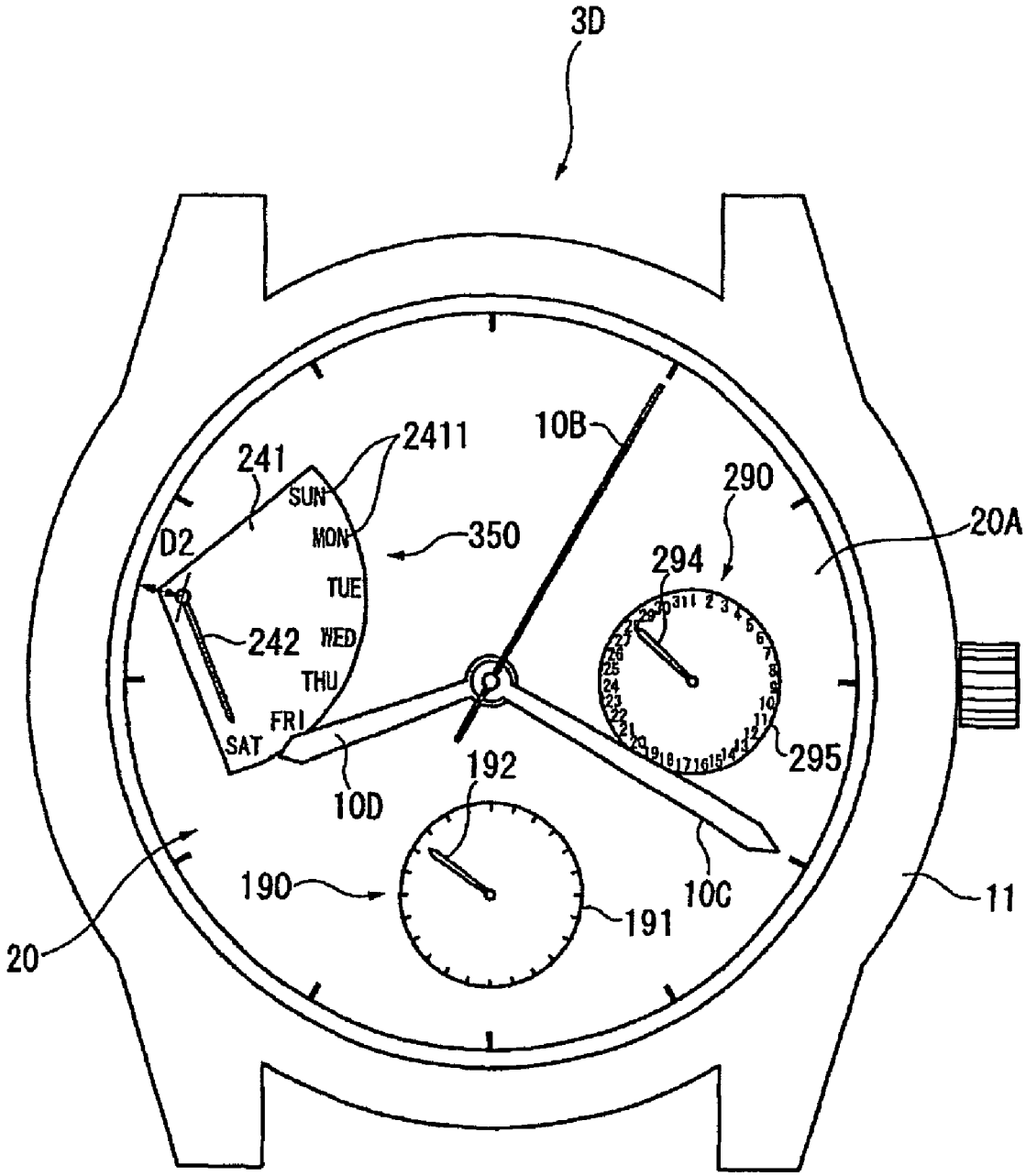
FIG. 17 is a plan view showing the appearance of another model of a timepiece according to the fifth embodiment of the invention.
Figure 18A:
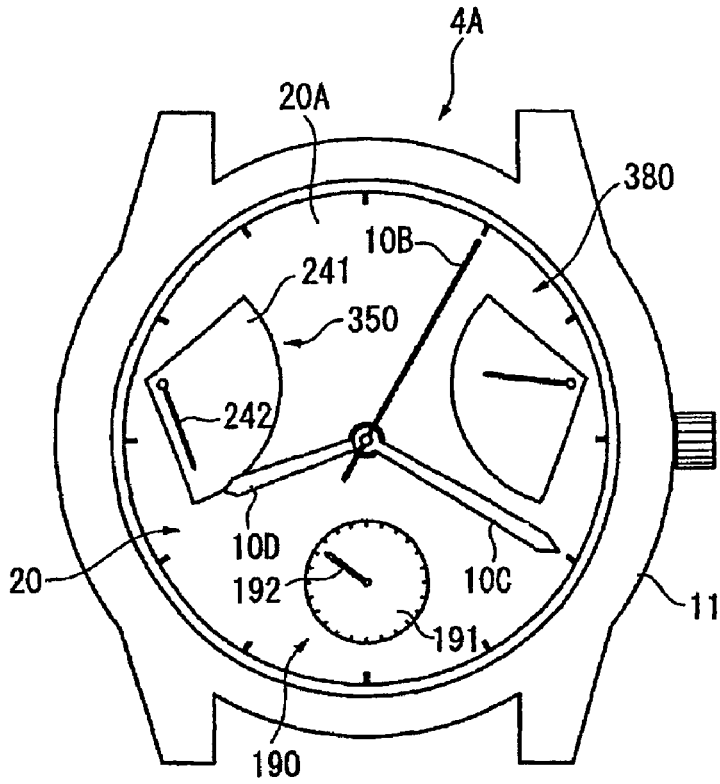
FIG. 18 is a plan view showing the appearance of a timepiece according to a variation of the present invention.
Figure 18B:
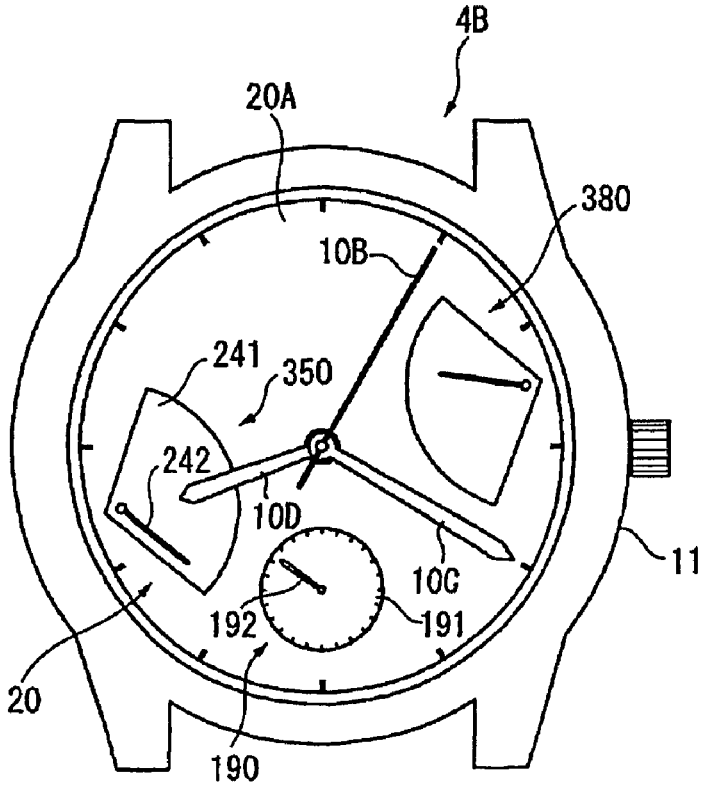
Figure 19A:
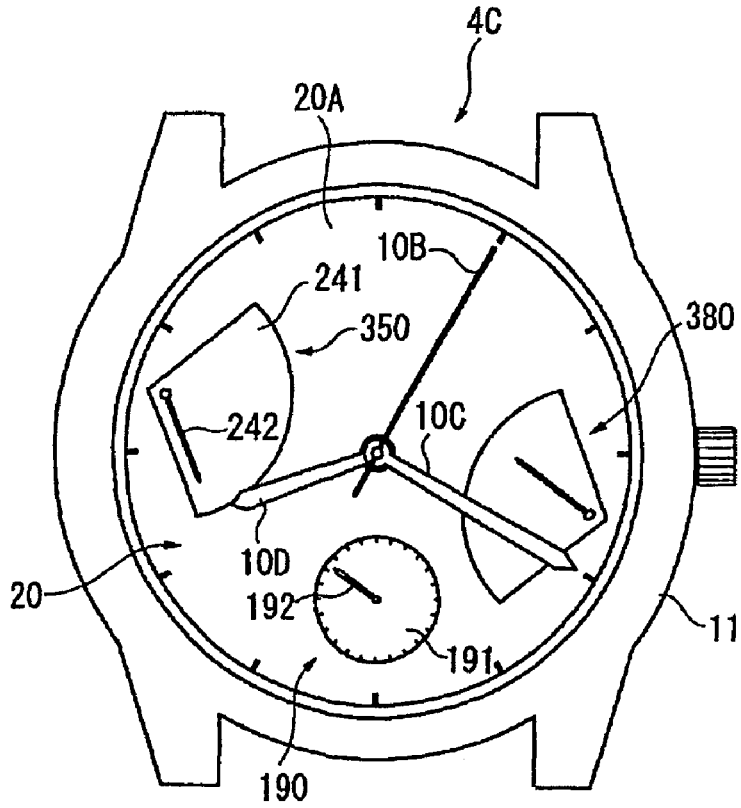
FIG. 19 is a plan view showing the appearance of a timepiece according to another variation of the present invention.
Figure 19B:
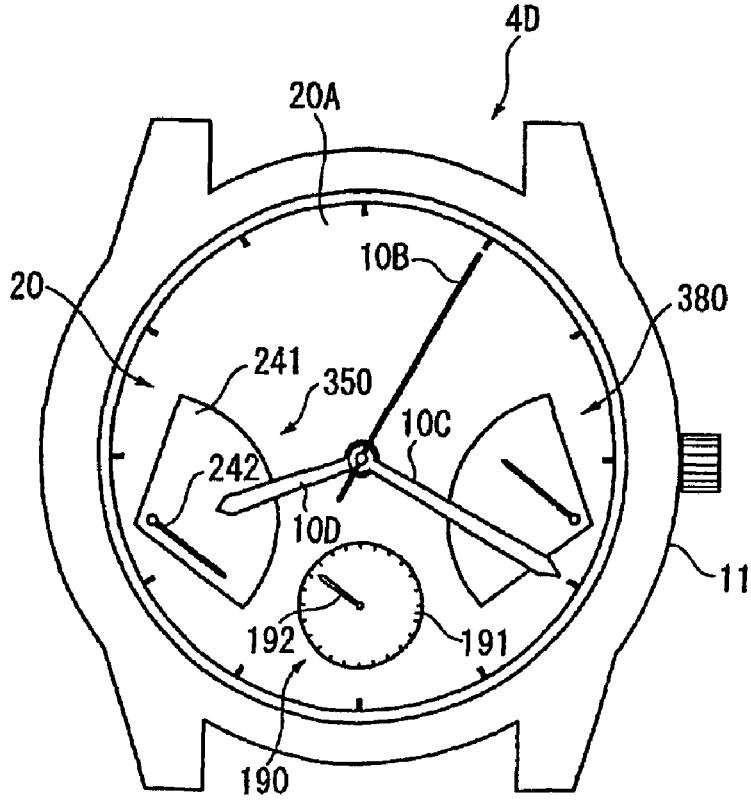
Figure 20:
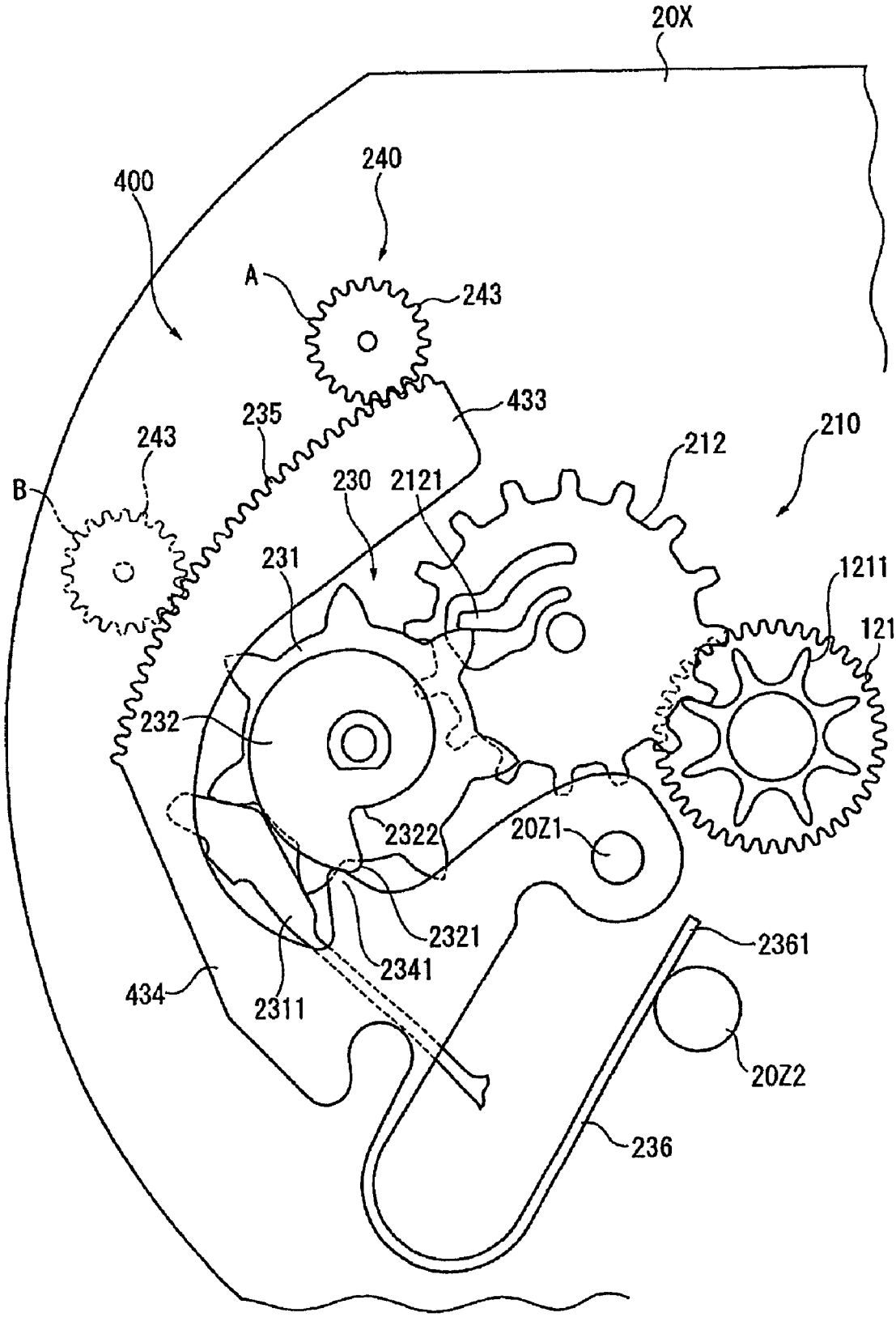
FIG. 20 is a plan view showing the appearance of a timepiece according to another variation of the present invention.

The invention claimed is:

1. A display apparatus for a timepiece, comprising:

a drive wheel that is rotated by a power source;

a transfer wheel that is driven by the drive wheel;

a driven wheel that is driven by the transfer wheel;

a cam fixed to said driven wheel and rotates with said driven wheel;

a lever that can move circularly and is urged in contact with the cam;

a rack that moves according to rotation of the cam by means of the intervening lever; and a pinion that rotates in conjunction with the rack and to which an indicating member can be attached;

wherein referenced to a hypothetical arc centered on the rotary axis of the lever and passing through the rotary axis of the cam, the rack is disposed on the opposite side of the arc as the center of the arc;

the rotary axis of the cam is located between the rack and the rotary axis of the lever; and wherein the lever forms a closed-loop around the cam.

2. A display apparatus for a timepiece as described in claim 1, wherein the distance from the rotary axis of the lever to the rotary axis of the pinion is 1.5 to 2.5 times the distance from the rotary axis of the lever to the rotary axis of the cam.

3. A display apparatus for a timepiece as described in claim 1, wherein the lever has a detent that contacts the cam.

4. A display apparatus for a timepiece as described in claim 1, wherein the rack meshes with the pinion when the pinion is disposed to any of a plurality of different positions.

5. A display apparatus for a timepiece as described in claim 4, wherein the rack has a plurality of partial racks corresponding to the plurality of different pinion positions, and the diameter and/or tooth form is different in each of said partial racks.

6. A display apparatus for a timepiece as described in claim 4, wherein the diameter and/or tooth form of the pinions disposed to said plural positions differ according to the position of the pinion.

7. A display apparatus for a timepiece as described in claim 1, further comprising an urging means causing the lever to contact the cam.

8. A display apparatus for a timepiece as described in claim 1, wherein:

an hour hand is attached to the drive wheel said transfer wheel has a feed pawl for advancing the driven wheel, said transfer wheel being disposed between the drive wheel and the driven wheel.

9. A display apparatus for a timepiece as described in claim 8, wherein the rotary axis of the lever is disposed proximate to the drive wheel.

10. A movement in which can be assembled a display apparatus for a timepiece as described in claim 1.

11. A timepiece comprising:

a display apparatus as described in claim 1; and a fan-shaped display unit which indicates time information or calendar information by means of said indicating member.

12. A display apparatus for a timepiece as described in claim 1, wherein the pinion has an axis of rotation different from the axis of rotation of the drive wheel.

13. A display apparatus for a timepiece as described in claim 1, wherein the drive wheel, transfer wheel, and driven wheel each have a different axis of rotation.

14. A display apparatus for a timepiece as described in claim 1, wherein the rotary axis of the lever is located between the rotary axis of the cam and the rotary axis of the drive wheel.

15. A display apparatus for a timepiece as described in claim 1, wherein the drive wheel is disposed on the opposite side of the arc as the rack.

16. A display apparatus for a timepiece as described in claim 1, further having a plurality of said pinions at different locations; and the rack has a plurality of mesh sections, one for each of said plurality of pinions, wherein each mesh section meshes with its corresponding pinion.

17. A display apparatus for a timepiece as described in claim 1, further having a purity of pinion location holders and the pinion is positioned at one of said pinion location holders;

wherein the rack has a plurality of partial racks corresponding to the locations of the plurality of pinion location holders, and the diameter and/or tooth form is different in each of said partial racks.

* * * * *